US009492342B2

(12) United States Patent
Hall

(10) Patent No.: US 9,492,342 B2
(45) Date of Patent: Nov. 15, 2016

(54) KNEE REHABILITATION DEVICE

(75) Inventor: Jacob Randy Hall, Draper, UT (US)

(73) Assignee: Promotus LLC, Draper, UT (US)

( * ) Notice: Subject to any disclaimer, the term of this patent is extended or adjusted under 35 U.S.C. 154(b) by 296 days.

(21) Appl. No.: 13/048,861

(22) Filed: Mar. 15, 2011

(65) Prior Publication Data

US 2011/0224585 A1 Sep. 15, 2011

Related U.S. Application Data

(60) Provisional application No. 61/314,135, filed on Mar. 15, 2010.

(51) Int. Cl.

| | |
|---|---|
| ***A63B 23/035*** | (2006.01) |
| ***A61H 3/00*** | (2006.01) |
| ***A61H 1/02*** | (2006.01) |

(52) U.S. Cl.

CPC ..... *A61H 1/024* (2013.01); *A61H 2201/0161* (2013.01); *A61H 2201/1269* (2013.01)

(58) Field of Classification Search

CPC ..... A61H 3/00–3/06; A63B 2023/006–2023/035

USPC ..... 601/123, 137, 34, 5, 129, 24, 27, 32, 601/33; 482/112, 124, 131, 139, 148, 79, 482/91, 97, 105, 134, 137, 51, 80, 907; 602/23, 26, 5, 35, 6; 128/882; 297/423.32

See application file for complete search history.

(56) References Cited

U.S. PATENT DOCUMENTS

| | | | | |
|---|---|---|---|---|
| 1,066,190 | A * | 7/1913 | Ellingsworth | A61F 5/0585 602/5 |
| 1,336,695 | A * | 4/1920 | Gromes | A61F 5/0102 473/217 |
| 2,010,482 | A * | 8/1935 | Cobb | 623/31 |

(Continued)

FOREIGN PATENT DOCUMENTS

| | | |
|---|---|---|
| EP | 0350956 | 7/1990 |
| JP | 2002-065770 | 3/2002 |
| KR | 10-2009-0022266 | 3/2009 |

OTHER PUBLICATIONS

International Search Report for PCT/US2011/028575 dated Nov. 28, 2011.

(Continued)

*Primary Examiner* — Loan H Thanh
*Assistant Examiner* — Rae Fischer
(74) *Attorney, Agent, or Firm* — Workman Nydegger

(57) ABSTRACT

A knee rehabilitation device is provided which can be used in various stages of knee rehabilitation to facilitate a full range of knee motion and promote joint flexibility following a knee impairment. The device, which can be used by a patient with or without the aid of medical personnel, is simple to use, compact, and is highly adjustable to accommodate different therapy regimens, and different leg sizes. To achieve maximum stretch of affected tissues of a pathologic joint, the device can be used without the need of lower extremity muscle involvement. A first embodiment device is machined or cast from a lightweight structural metal, such as titanium, aluminum or magnesium. The device includes a handle of adjustable length that is rotatably coupled to a parallel-beam leg support. The leg support provides attachment points for multiple adjustable bands that bridge the gap between the parallel beams.

20 Claims, 24 Drawing Sheets

(56) References Cited

U.S. PATENT DOCUMENTS

| | | | | | |
|---|---|---|---|---|---|
| 2,058,563 | A | * | 10/1936 | Campbell | 601/33 |
| 2,413,053 | A | | 12/1946 | Kolarik | |
| 2,545,843 | A | * | 3/1951 | Cohan | A61F 5/0125 403/79 |
| 3,000,632 | A | * | 9/1961 | Fuchs | 482/97 |
| 3,502,071 | A | * | 3/1970 | Holly | 601/34 |
| 4,252,111 | A | * | 2/1981 | Chao | 602/16 |
| 4,252,112 | A | * | 2/1981 | Joyce | 602/26 |
| 4,485,808 | A | | 12/1984 | Hepburn | |
| 4,494,534 | A | * | 1/1985 | Hutson | A61F 5/0125 602/16 |
| 4,599,996 | A | * | 7/1986 | Seith et al. | 601/34 |
| 4,665,905 | A | | 5/1987 | Brown | |
| 4,784,121 | A | * | 11/1988 | Brooks | 601/34 |
| 4,801,138 | A | * | 1/1989 | Airy et al. | 482/112 |
| 4,844,454 | A | * | 7/1989 | Rogers | 482/131 |
| 4,848,326 | A | | 7/1989 | Lonardo | |
| 4,905,677 | A | | 3/1990 | Pecheux | |
| 5,236,333 | A | * | 8/1993 | Barba, Jr. | A61H 1/024 482/125 |
| 5,253,639 | A | | 10/1993 | Johnston | |
| 5,306,230 | A | | 4/1994 | Bodine | |
| 5,453,075 | A | | 9/1995 | Bonutti et al. | |
| 5,509,894 | A | | 4/1996 | Mason et al. | |
| 5,685,830 | A | | 11/1997 | Bonutti | |
| 5,687,742 | A | | 11/1997 | Johnson | |
| 5,855,538 | A | | 1/1999 | Argabright | |
| 5,891,061 | A | * | 4/1999 | Kaiser | A61F 5/0125 601/33 |
| 6,821,262 | B1 | | 11/2004 | Muse et al. | |
| 6,962,570 | B2 | | 11/2005 | Callanan et al. | |
| 7,207,960 | B2 | | 4/2007 | Kenney | |
| 7,309,305 | B2 | * | 12/2007 | Nichols | 482/148 |

OTHER PUBLICATIONS

International Preliminary Report on Patentability dated Sep. 18, 2012 from International Patent Application No. PCT/US2011/028575, filed Mar. 15, 2011.

U.S. Appl. No. 14/213,714, Apr. 6, 2015, Office Action.

* cited by examiner

KNEE REHABILITATION DEVICE

This application has a priority date based on the filing, by the same inventor, of Provisional Patent Application No. 61/314,135 on Mar. 15, 2010

BACKGROUND OF THE INVENTION

1. Field of the Invention

This invention relates generally to mechanical devices used to facilitate knee range of motion, which can be used in various stages of knee rehabilitation and more particularly, to an apparatus that can be used by a patient, with or without the aid of medical personnel, to engage in full joint flexibility following a knee impairment which can be used in multiple positions, by multiple methods, and multiple locations due to convenience of size and simplicity of use.

2. History of the Prior Art

Medical patients who have undergone knee joint surgery, or have otherwise suffered joint impairment, typically require rehabilitative therapy so that an optimum range of motion can be achieved for the affected joint. The two most common knee surgeries are repair of the anterior cruciate ligament (ACL) and complete joint replacements. Over ten million such surgeries are performed worldwide, with over ten percent of that number occurring in the U.S., alone. Following knee surgery, it is imperative that the patient undergo rehabilitative therapy in order to recover full range of motion in the affected joint.

Patient compliance with therapeutic protocol is important in order to obtain full joint flexibility and function. Patient compliance with existing knee contracture correction devices and continuous passive motion devices tends to be low due to complexity, difficulty-of-use, and/or cost. The present invention provides a simple, cost-efficient, comfortable, and easy-to-use solution. In addition there is no assembly of bands required to attach the device to a lower extremity during a therapy session, as in Velcro (registered trademark), buckles, etc. The present invention may also be used in many different positions, including supine, recumbent, or even standing and walking, and can be used in many different locations, including clinics, home, hospital, office, or even in water, as in a therapy pool or spa, or any other unique therapeutic environment.

As the therapy requires a significant amount of time and involves a certain amount of discomfort—particularly as the leg is extended—manual therapy devices, which are controlled by the patient are preferred. A number of manual devices have been developed over the years for facilitating rehabilitative therapy of the knee.

U.S. Pat. No. 6,962,570 to Keith E. Callanan, et al. describes a knee extension therapy apparatus for use by a patient in a recumbent position having the foot of his leg to be treated elevated to a level above the surface upon which the patient user is resting. The apparatus is equipped with a force translation pulley system, which subjects the knee to straightening forces when the patient pulls on a cord. The apparatus can be collapsed for easy transport.

U.S. Pat. No. 6,821,262 to Richard R. Muse, et al. discloses a device for extending the leg of a patient following knee surgery. The device comprises an elongated member having a handle at one end, a harness for holding the patient's foot attached to the other end, and an adjustable slider assembly that can be positioned at a variety of locations along the elongated member. A fulcrum, which is attached to the slider assembly rests on top of the patient's leg, either above or below the knee, while the harness supports the patient's foot. The device is operated by the patient pulling on the handle, thereby straightening the leg, which increases the range of motion of the knee joint.

U.S. Pat. No. 5,855,538 to John Argabright discloses an exercise device that allows the use to extend each leg separately from a sitting position. A pair of upwardly curved tracks are affixed to horizontal base members by the rear support members and to vertical base members by the top support members. Tracks extend upwardly toward the forward end of the invention. The two foot plates are affixed to tracks by the foot plate attachment to move forward and rearward. A pair of foot supports are affixed to foot plates, wherein they can adjustably fit to a human being's feet as the legs are extended.

U.S. Pat. No. 5,685,830 to Peter M. Bonutti discloses an adjustable orthosis for stretching tissue by moving a joint between first and second relatively pivotal body positions. The orthosis includes a first arm with a cuff at its outer end to releasably attach the first arm to the first body portion. A second arm with a cuff at its outer end releasably attaches the second arm to the second body portion. The arms are pivotally interconnected by a connector section which is formed as one-piece with the first and second arms. An actuator is connected to the arms to apply force to the arms to pivot them relative to each other to move the joint. The actuator includes a flexible force transmitting member connected with at least one of the arms. A drive assembly is provided to tension the flexible force transmitting member and move the first and second arms relative to each other.

U.S. Pat. No. 5,509,894 to Bardley R. Mason, et al. discloses a leg suspension device for rehabilitative exercise of the leg, and specifically for passive or active range of motion exercise of the knee or hip joint. The device includes a bar having proximal and distal segments, and a fulcrum rotatably engaging the bar between the proximal and distal segments to permit rotation of the bar about the fulcrum in a vertical plane. Upper and lower leg cuffs are connected to the proximal and distal segments, respectively, suspending the thigh and leg while isolating the knee joint. A base is provided to free-standingly support the device during use, or, alternatively, the device is adapted for affixing to an overhead anchor. For passive motion exercise, the thigh and ankle are suspended from the cuffs and the user drives rotation of the bar solely with the upper body muscles about the fulcrum in alternate opposing directions, causing alternate passive flexion and extension of the knee and hip joint. The same procedure is repeated for assisted active motion exercise, but the user drives rotation of the bar about the fulcrum with the upper body and leg muscles simultaneously. For independent active motion exercise, the user drives rotation of the bar about the fulcrum entirely with the leg muscles. U.S. Pat. No. 4,665,905 to Charles S. Brown discloses a pair of wire-frame structures, each of which is made of two parallel aligned members. Both wire-frame structures are joined by a pair of coil compression springs. A U-shaped yoke is adjustably affixed to each end of the aligned members. Each yoke is hinged to a cuff suitable for attachment to a human arm or leg by self-fastening bands. In use, the brace assemblage provides a dynamic tension to apply a controlled force on an elbow or knee flexion contracture.

U.S. Pat. No. 4,485,808 to George R. Hepburn discloses an adjustable splint assembly having upper and lower struts which are pivotally connected, with the pivotal connection incorporating a cam integral with one of the struts and a adjustable biasing mechanism within the other strut that applies a quantifiable force to the cam. The amount of force applied to the cam determines the torque required to flex the splint assembly at the pivotal connection. The splint is attached to a limb via hook and loop fasteners, with a pivotal axis of the limb joint (i.e., knee or elbow) being positioned coaxial with the pivotal axis of the splint's pivotal connection.

SUMMARY OF THE INVENTION

The invention relates to a device for treating impairments in body joints from extension contracture, weakness in the supporting musculature, or some other malady in inhibiting the integrity of the body joint in accomplishing range of motion, weakness, or lack of full functionality. People develop extension contractures in knees and other joints from many and various causes. Weakness, disuse, fractures, surgeries, illness, and other causes have been known to cause loss of ability to flex the body joint otherwise known as an extension contracture.

The present invention provides several embodiments of a knee rehabilitation device, which can be used by an individual to assist the rotational component of the affected joint through its entire anatomical plane. It may be performed with or without the need of lower extremity muscle involvement. It is optimum to reduce lower extremity muscle recruitment in order to achieve a maximal stretch to the affected tissues related to the pathologic joint.

A first embodiment knee rehabilitation device is machined or cast from a lightweight structural metal, such as titanium, aluminum or magnesium. The device includes a generally U-shaped handle of adjustable length that is rotatably coupled to a parallel-beam leg support. The leg support provides attachment points for an upper band that bridges the gap between the parallel beams and two pair of longitudinal slots, in which can slide a middle band and a lower band. The middle and lower bands also bridge the gap between the parallel beams. The lower band, which is used to support the leg beneath the ankle, slides within the lower of the two pair of longitudinal slots so that different leg sizes can be accommodated. The middle band, which fits over the anterior portion of the leg and inferior to the knee, can also be slid within the upper of the two pair of longitudinal slots. The adjustability of the middle band allows for different forces to be applied to the knee joint when a force is applied by the user of the device. The upper band, the position of which is non-adjustable, fits over the anterior portion of the leg either above or below the knee. The U-shaped handle can be locked to the leg support at one of multiple positions throughout a range of rotation. It can make an acute angle, a right angle or an obtuse angle with the leg support. It can even be rotated to a storage position, whereby it makes essentially an angle of zero degrees with the leg support. A second embodiment knee rehabilitation device, which is a variation of the first embodiment knee rehabilitation device, incorporates a rotatable support structure to which the upper and middle bands attach. The rotatable support structure enables the upper and middle bands to rotate independently of the leg support.

The U-shaped handle can also be detached from the first and second embodiment knee rehabilitation devices and secured to a conventional post-operative knee brace that has been modified to include handle attachment hardware near the knee joint. A third embodiment knee rehabilitation device includes a non-adjustable frame that is preferably fabricated entirely from a single piece of high-strength structural metal tubing. Structural metals include high-strength steel and stainless steel alloys, heat-treated aluminum, titanium and magnesium, and alloys thereof.

A leg support portion of the device is formed by first and second spaced-apart parallel tube sections joined by a first U-shaped loop. The handle portion, formed by third and fourth spaced-apart parallel tubes joined by a second U-shaped look, makes an obtuse angle with the leg support portion, with which it is integral. Upper, middle and lower bands are coupled to the first and second parallel tubes and are slidable thereon for adjustability. The opposite ends of the single piece of metal tubing which forms the frame of the device are preferably joined in one of the U-shaped loop regions via either a butt-welded joint, or a brazed or adhesively-bonded sleeve joint.

A fourth embodiment knee rehabilitation device has a frame made of a pair of laminar sheet material components disposed in a mutually-parallel configuration, which can be a structural metal such as aluminum, steel alloys, stainless steel alloys, magnesium alloys and titanium. The laminar sheet material can also be a polymeric material, such as polyester thermoplastic resin that is reinforced by structural fibers such as para-aramid (e.g., Kevlar®), glass and carbon. Each of the frame components is reminiscent of a hockey stick or boomerang, with one end of each serving as a handle and the other serving as half of the leg support. Front, middle and rear bands bridge the gap between the two frame components. Each frame component is equipped with a pair of longitudinal slots, in tandem, in the leg support portion, which enables the front and middle band to adjustably slide back and forth in order to accommodate different sizes of patients and different therapy positions.

For any of the four embodiments of the knee rehabilitation device, the bands (also referred to as "bands" or "strap") can be made of durable cloth, a durable polymer such as polypropylene, leather, a composite sheet material (e.g., rubberized cloth), or some equivalent material.

DETAILED DISCLOSURE OF THE INVENTION

The various embodiments of the knee rehabilitation device will now be described in detail with reference to the attached drawing figures. It should be understood that the drawings are not necessarily drawn to exact scale and are meant to be illustrative of the invention.

Figure 1A:
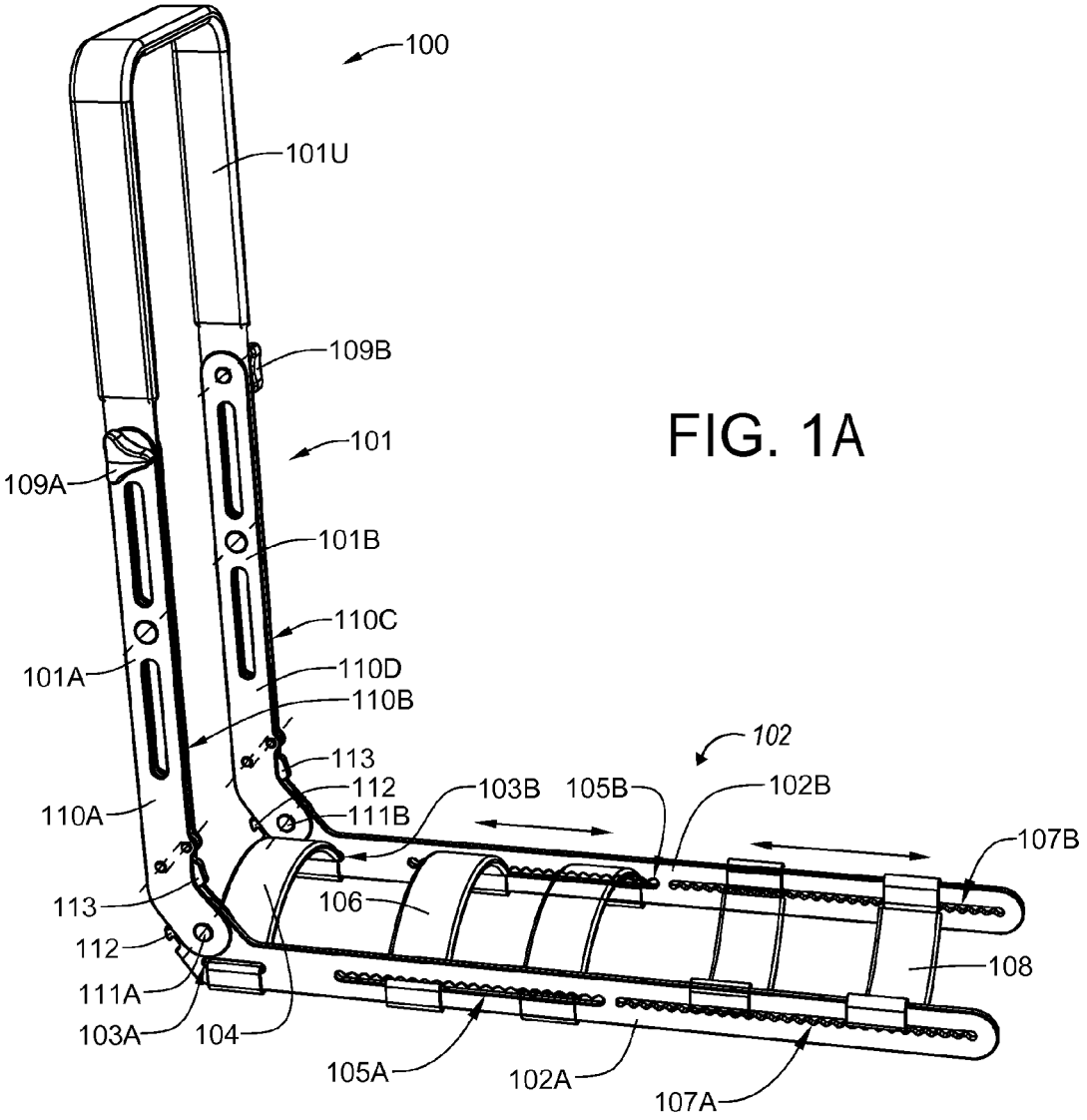
FIG. 1A is an isometric view of the first embodiment knee rehabilitation device showing how the middle band 106 and the ankle band 108 can be slidably moved to accommodate patients of different sizes.
Figure 1B:
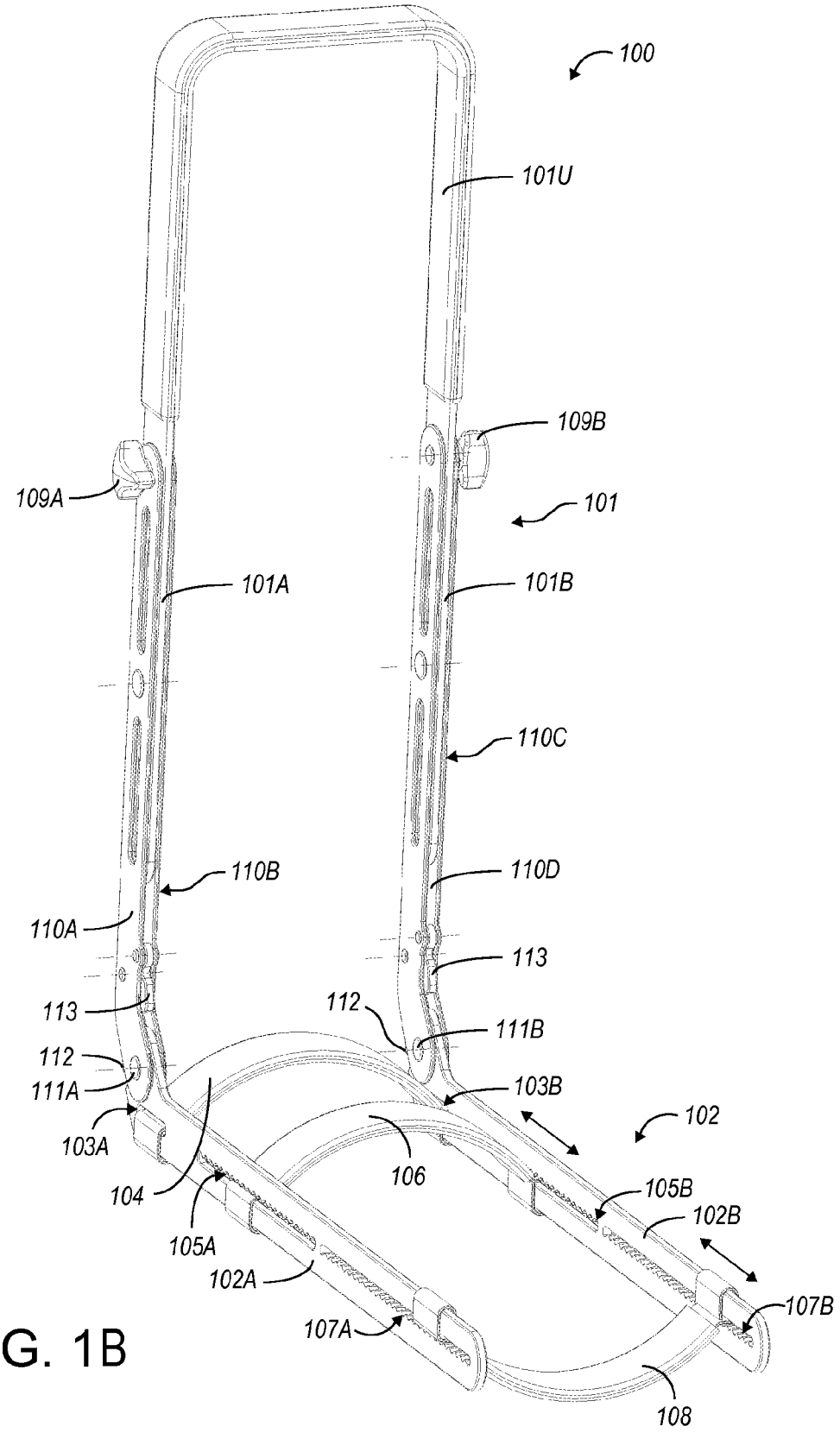
FIG. 1B is an isometric view of the device of FIG. 1B from a front perspective and shows the handle 101U slidably attached between members 110A and 110B and between 110C and 110 D.
Figure 2:
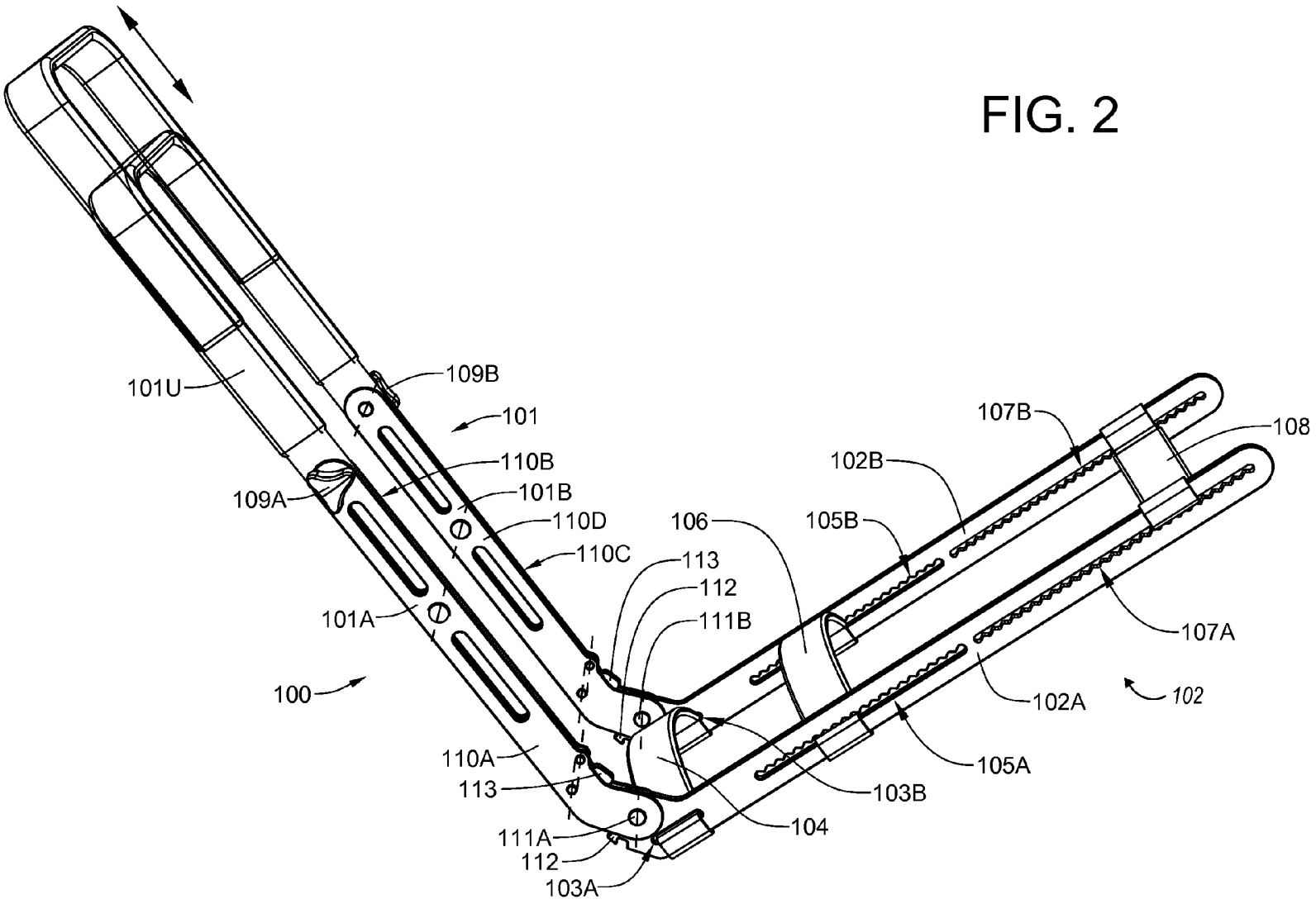
FIG. 2 is an isometric view of the first embodiment knee rehabilitation device also showing the handle length adjustment feature.

Referring now to FIGS. 1A, 1B and 2, a first embodiment knee rehabilitation is shown. Fabricated mostly of a light-weight structural metal, such as titanium, aluminum or magnesium or alloys thereof, the first embodiment knee rehabilitation device 100 includes a generally U-shaped handle 101 of adjustable length that is rotatably coupled to a parallel-beam leg support 102. The leg support 102 provides a pair of upper attachment slots 103A and 103B for mounting of an upper band 104 that bridges the gap between the parallel beams 102A and 102B, a first pair of elongated attachment slots 105A and 105B for mounting of a slidably-adjustable middle band 106, and a second pair of elongated attachment slots 107A and 107B for mounting of a slidably-adjustable lower band 108. The middle and lower bands 106 and 108, respectively, also bridge the gap between the parallel beams 102A and 102B. The lower band 108, which is used to support the leg beneath the ankle, slides within the lower of the second pair of longitudinal slots 107A and 107B so that different leg sizes and different injuries and/dr surgical incisions can be accommodated. The middle band 106, which fits over the front of the patient's calf, can also be slid within the first, or upper pair of longitudinal slots 105A and 105B. The adjustability of the middle band 106 allows for different forces to be applied to the knee joint during therapeutic use, as well as accommodate injuries or surgical incision locations. Although the position of the upper band 104 is non-adjustable, it can be removed completely to accommodate certain therapy regimens. The upper band 104 fits over the front of the leg either just above or just below the knee, depending on the particular force desired during therapy. The U-shaped handle 101 has an upper portion 101 U that is slidably coupled to a pair of lower extensions 101A and 101B. Threaded fasteners, but not limited to threaded fasteners, having a unitary knob 109A and 109B secure each side of the upper portion 101U to each of the lower extensions 101A and 101B, respectively. Lower extension 101A is constructed of two parallel, closely-spaced lower extension sub-members 110A and 110B, while lower extension 101 B is constructed of identical lower extension sub-members 110C and 110D. The handle upper portion 101U slides between each pair of lower extension sub-members 110A and 110B or 110C and 110D, and the threaded fasteners 109A and 109B secure the handle upper portion 101U between each pair of lower extension sub-members 110A and 110B and lower extension sub-members 110C and 110D, respectively. Parallel beam 102A of the leg support 102 is coupled with a first hinge 111A to lower extension sub-members 110A and 110B, while parallel beam 102B is coupled with a second hinge 111B to lower extension sub-members 110C and 110D. Each hinge 111A and 111 B incorporates a notched locking disc 112 that is engaged by a pawl (not shown) that is actuated by release button 113.

Figure 3:
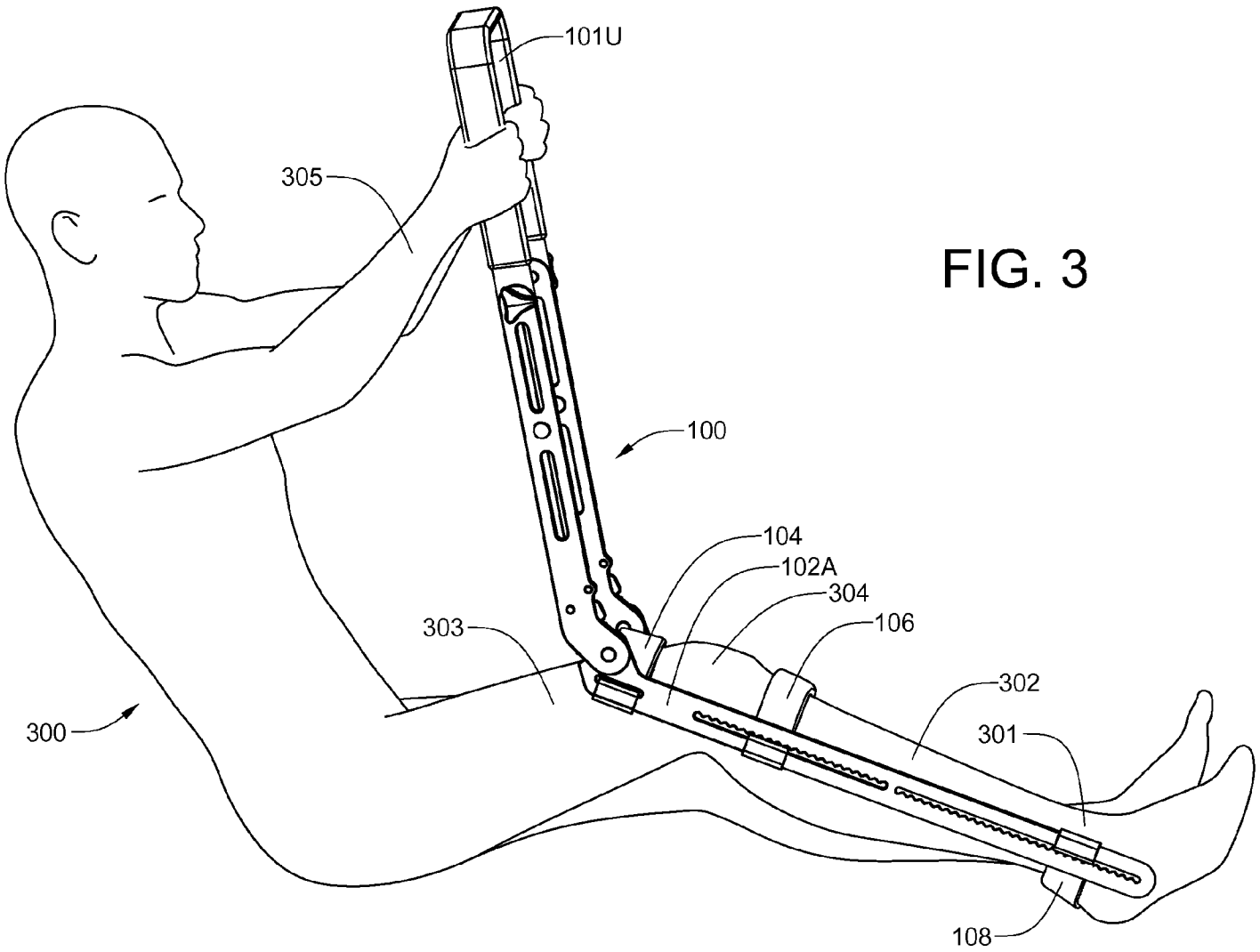
FIG. 3 is an isometric view of a first embodiment knee rehabilitation device being used by a patient.

Referring now to FIG. 3, the first embodiment knee rehabilitation device 100 is shown being used by a patient 300 in its standard operational mode.

Figure 4:
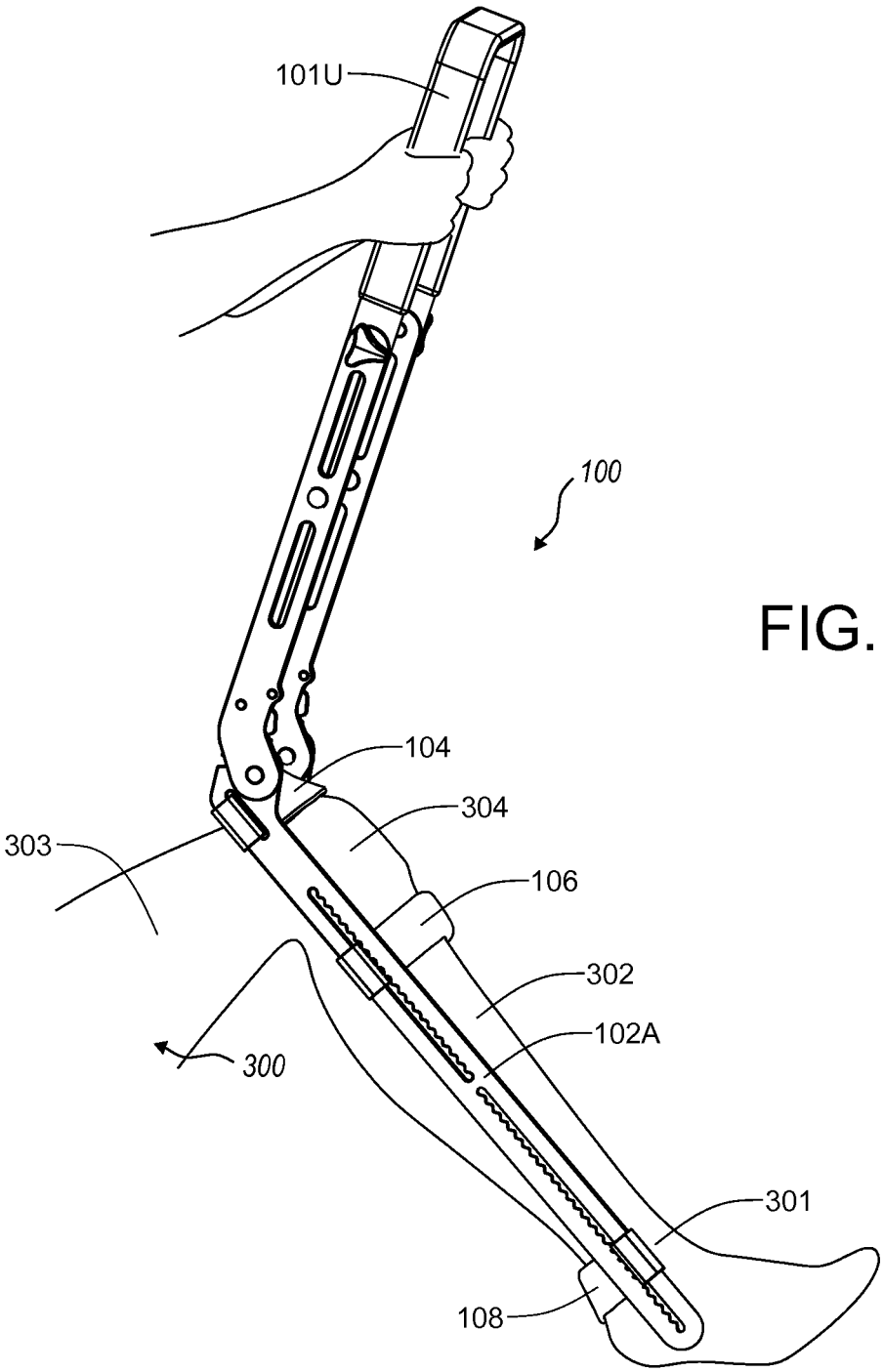
FIGS. 4, 5 and 6 show the first embodiment knee rehabilitation device being used by a patient to rotate his knee joint through various degrees of motion in FIGS. 4 and 5 to full extension in FIG. 6.
Figure 5:
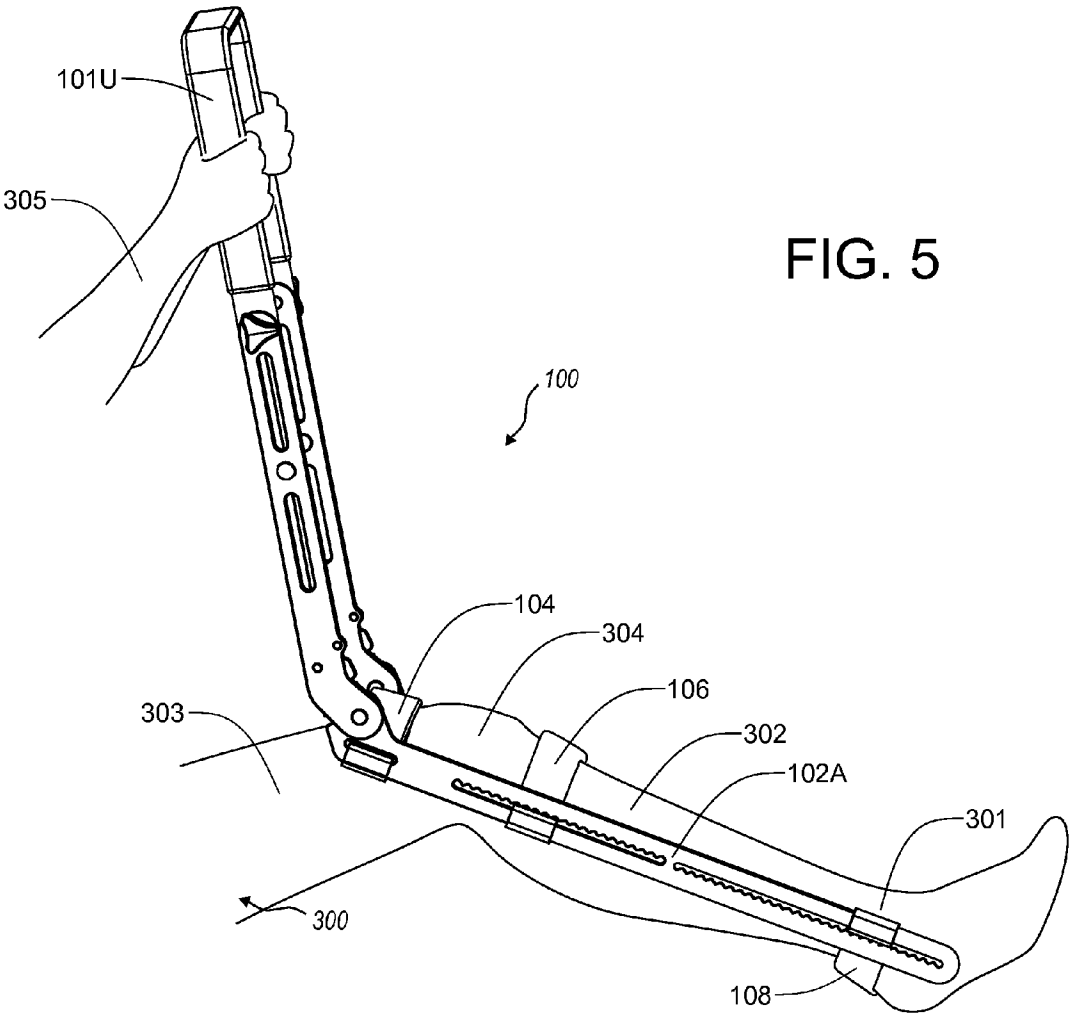
Figure 6:
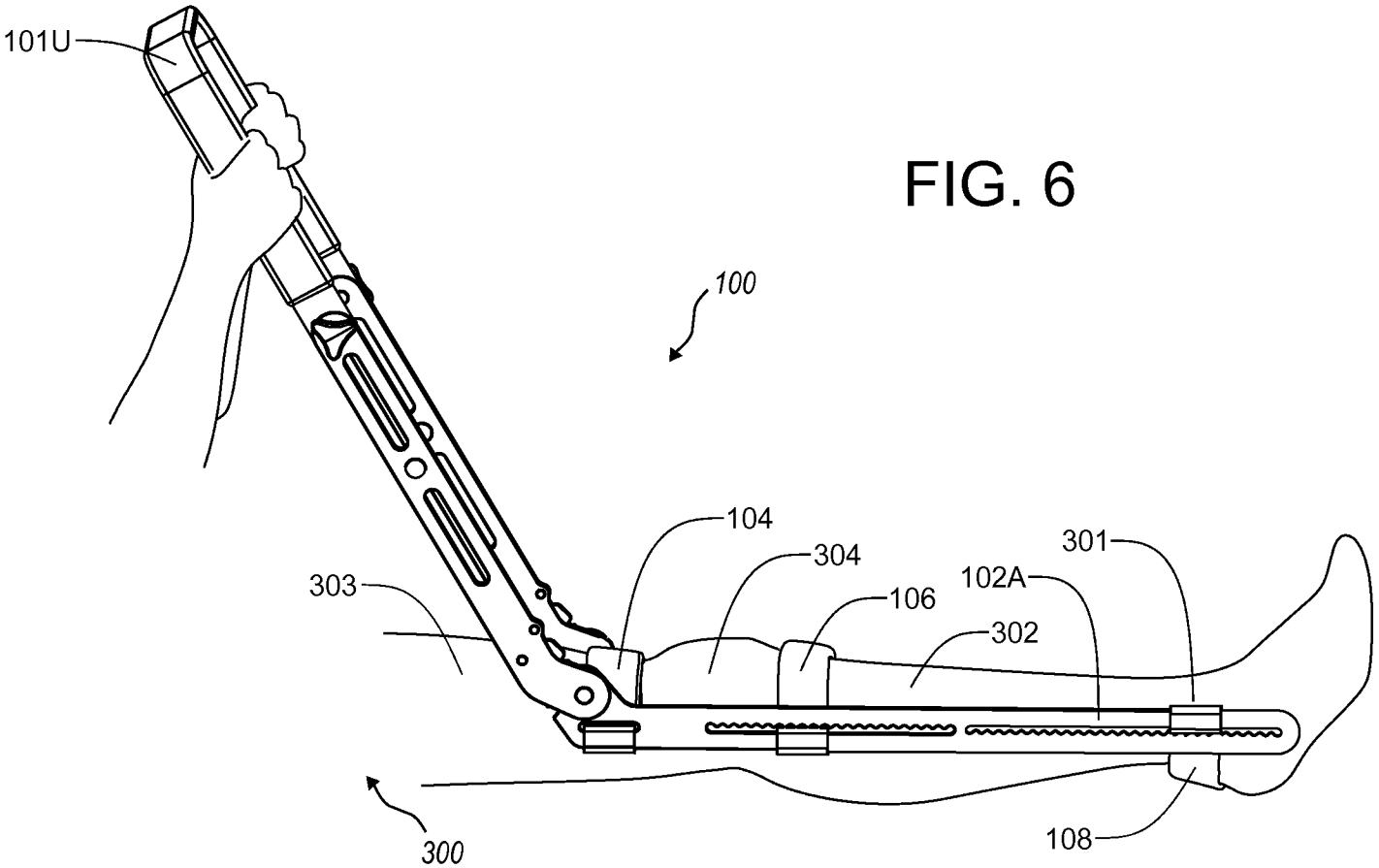

Referring now to FIGS. 4, 5 and 6, the first embodiment knee rehabilitation device 100 is being used by a patient 300 to rotate his knee 304 through various degrees of motion in FIGS. 4 and 5 to full extension in FIG. 6. It will be noted that for this therapy regime, the upper band 104 (also referred to as a band) is 15 positioned on the anterior portion of the thigh 303 just above the knee 304, the middle band 106 passes over the anterior portion of the lower leg 302 just below the knee 304, and the lower band 108 supports the lower leg 302 just posterior to the ankle 301. FIGS. 4, 5 and 6 show the first embodiment knee rehabilitation device in use by a patient 300 in its first, or standard, configuration, with the upper band 104 positioned just above the knee 304 on the anterior of the patient's thigh 303, the middle band 106 positioned on the anterior surface of the lower leg 302 just below the knee 304, and the lower band 108 positioned posterior to the ankle 301. In this First configuration, a moderate amount of pressure is applied to the knee 304.

Figure 7:
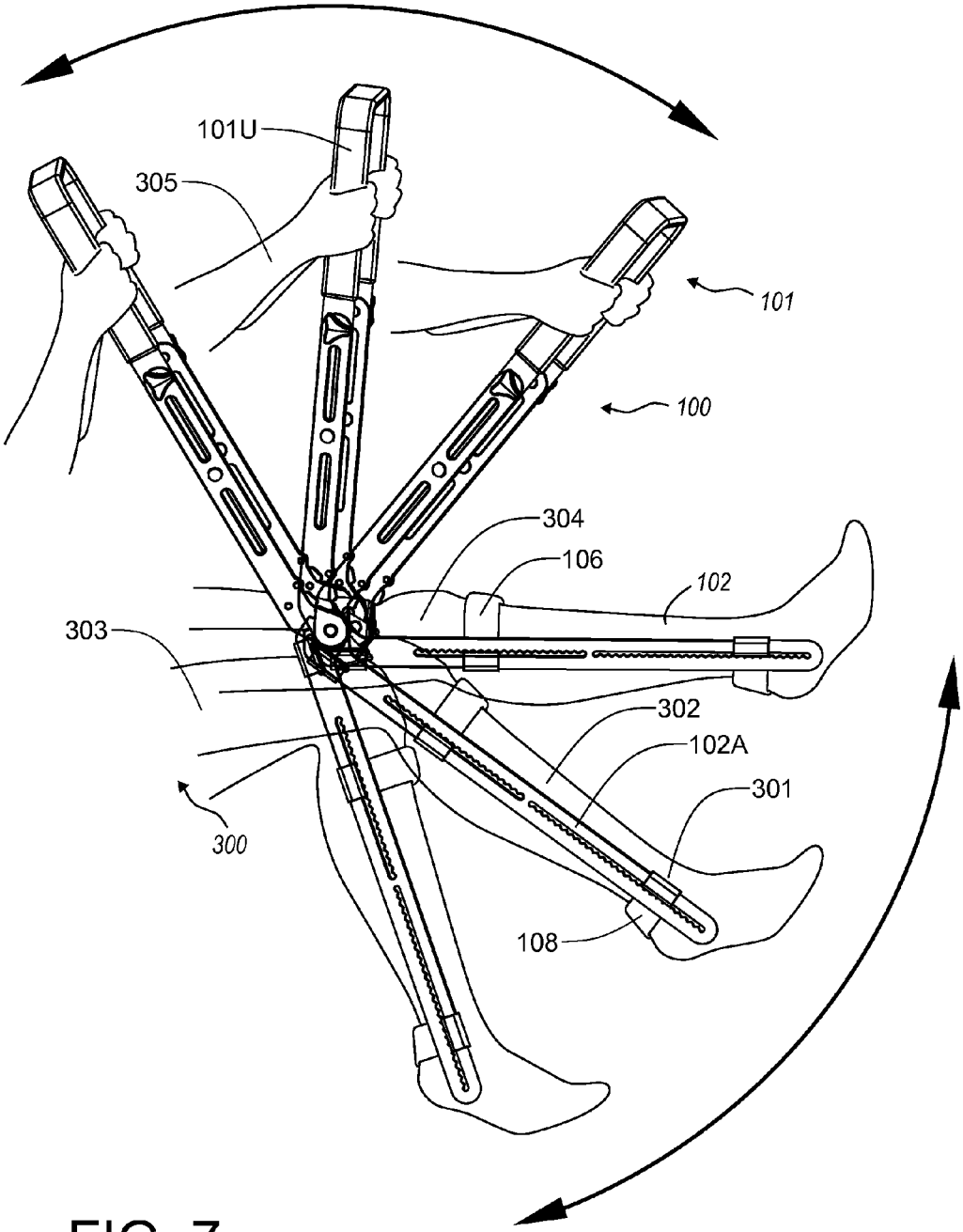
FIG. 7 is a right side elevational view of the first embodiment knee rehabilitation device being used by a patient, and showing how the device can be used for passive motion throughout the full range of joint motion.

Referring now to FIG. 7, the first embodiment knee rehabilitation device 100 is shown in use by a patient 300, as that patient moves the U-shaped handle 101, set on angular position B (see FIG. 8) with respect to the leg support 102, back and forth between positions of complete knee extension (represented by the horizontal leg configuration) and knee flexion (represented by the two non-horizontal leg configurations).

Figure 8:
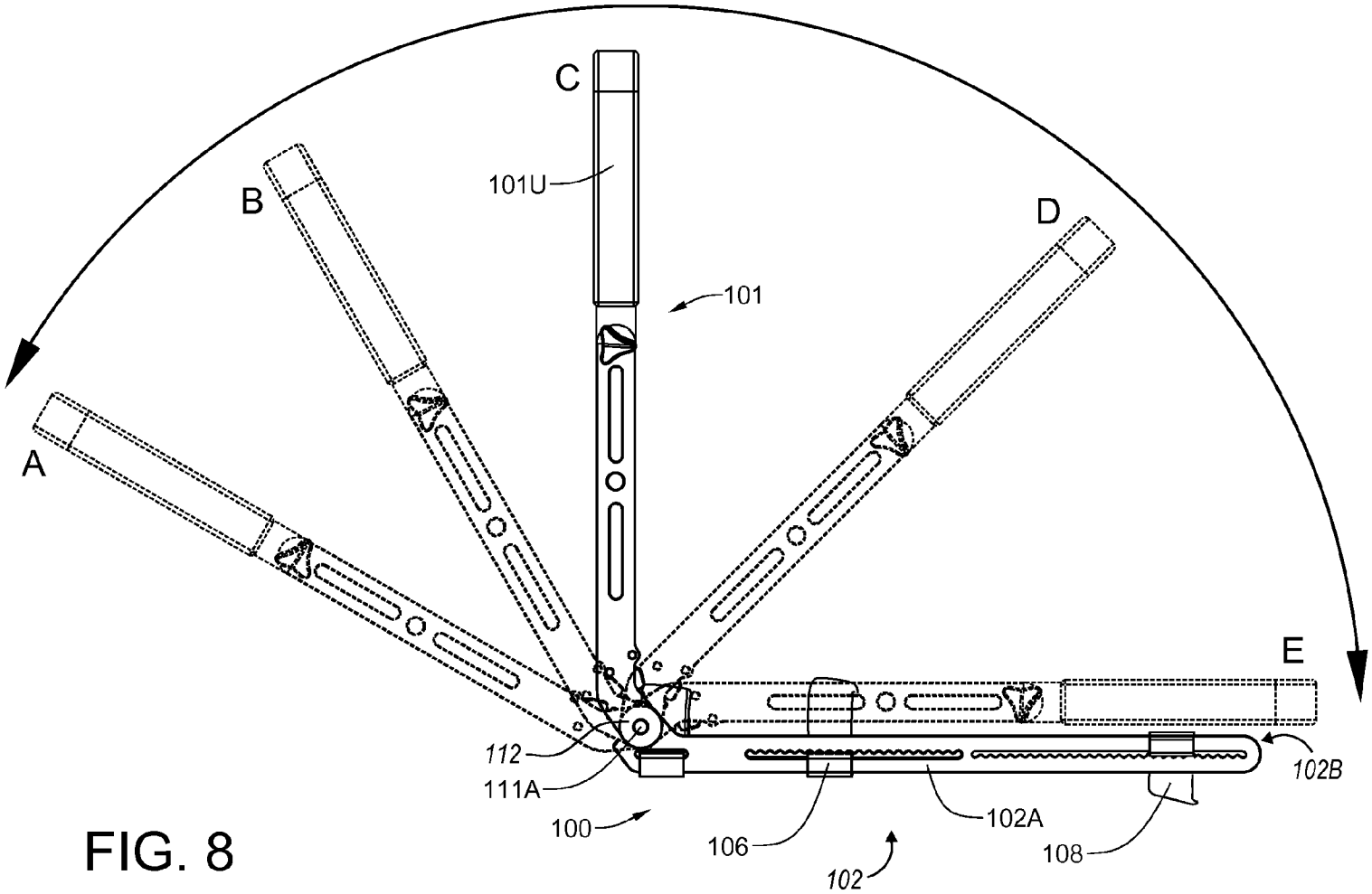
FIG. 8 is a side elevational view of the first embodiment knee rehabilitation device showing how the handle can be rotated and locked in a range of positions, including a completely folded position that can be used for storage.

Referring now to FIG. 8, each notched locking disc 112 provides a finite number of angularly-spaced lockable positions that the U-shaped handle 101 makes with the parallel beams 102A and 102B of the leg support 102. Five, but not limited to five, lockable angular positions A, B, C, D and E are shown in FIG. 8. Position E provides a compact device configuration for storage.

Figure 9:
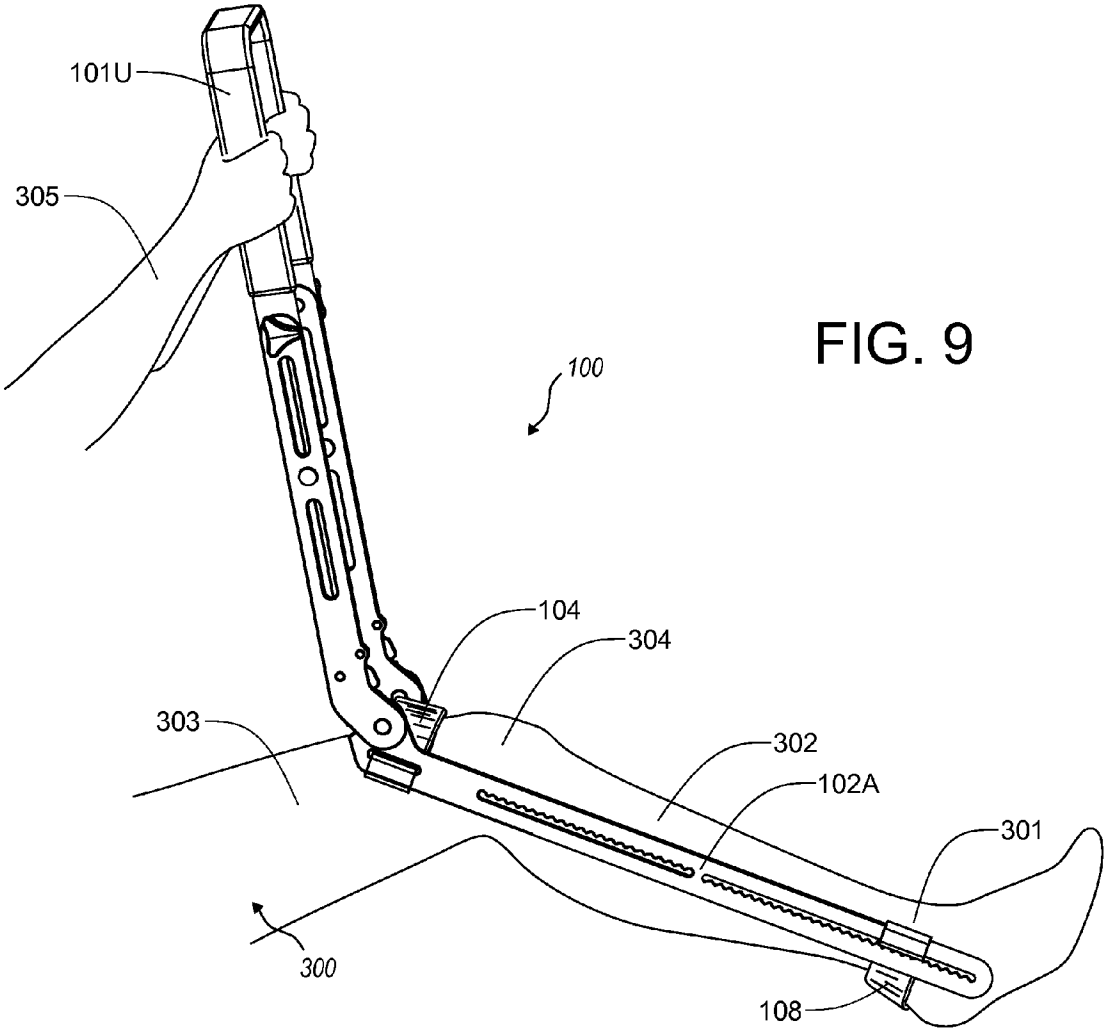
FIGS. 9, 10, and 11 show how the first embodiment knee rehabilitation device can be used with three other band configurations, each of which stretches the knee joint in a different way, with FIG. 9 showing the upper band positioned just superior to the knee, the middle band removed, and the lower band positioned posterior to the ankle, with FIG. 10 showing the upper band removed, the middle band positioned just inferior to the knee, and the lower band positioned posterior to the ankle, and FIG. 11 showing the upper band positioned just inferior to the knee, the middle band positioned inferior to the upper band and on the anterior portion of the leg, and the lower band positioned posterior to the ankle.

Referring now to FIG. 9, the first embodiment knee rehabilitation device 100 is shown in use by a patient 300 in a second configuration, with the upper band 104 positioned just above the knee 304 on the anterior of the patient's thigh 303, the middle band 106 (FIG. 8) removed, and the lower band 108 positioned posterior to the ankle 301. In this second configuration, minimum pressure is applied to the knee 304.

Figure 10:
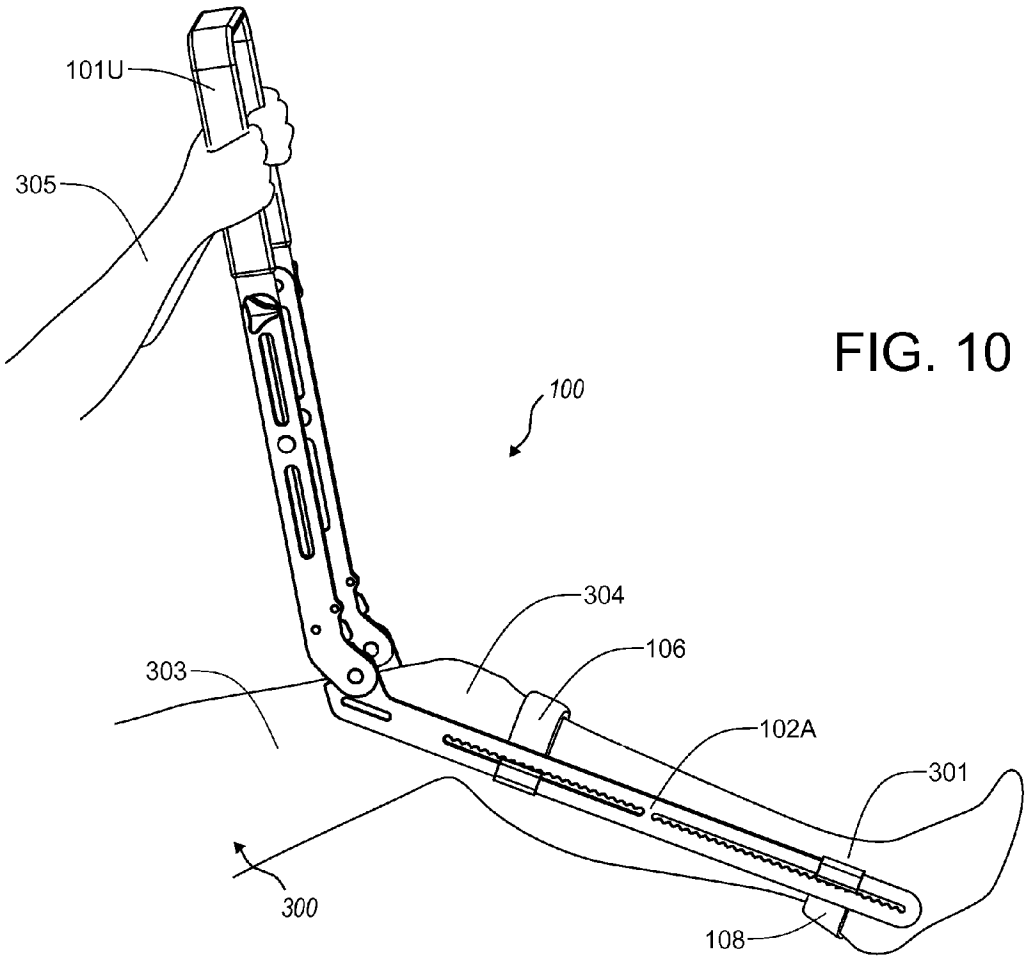

Referring now to FIG. 10, the first embodiment knee rehabilitation device 100 is shown in use by a patient 300 in a third configuration, with the upper band 104 (FIG. 9) removed, the middle band 106 positioned on the anterior surface of the lower leg 303 just below the knee 304, and the lower band 108 positioned posterior to the ankle 301. In this configuration, greater pressure is applied to the knee 304.

Figure 11:
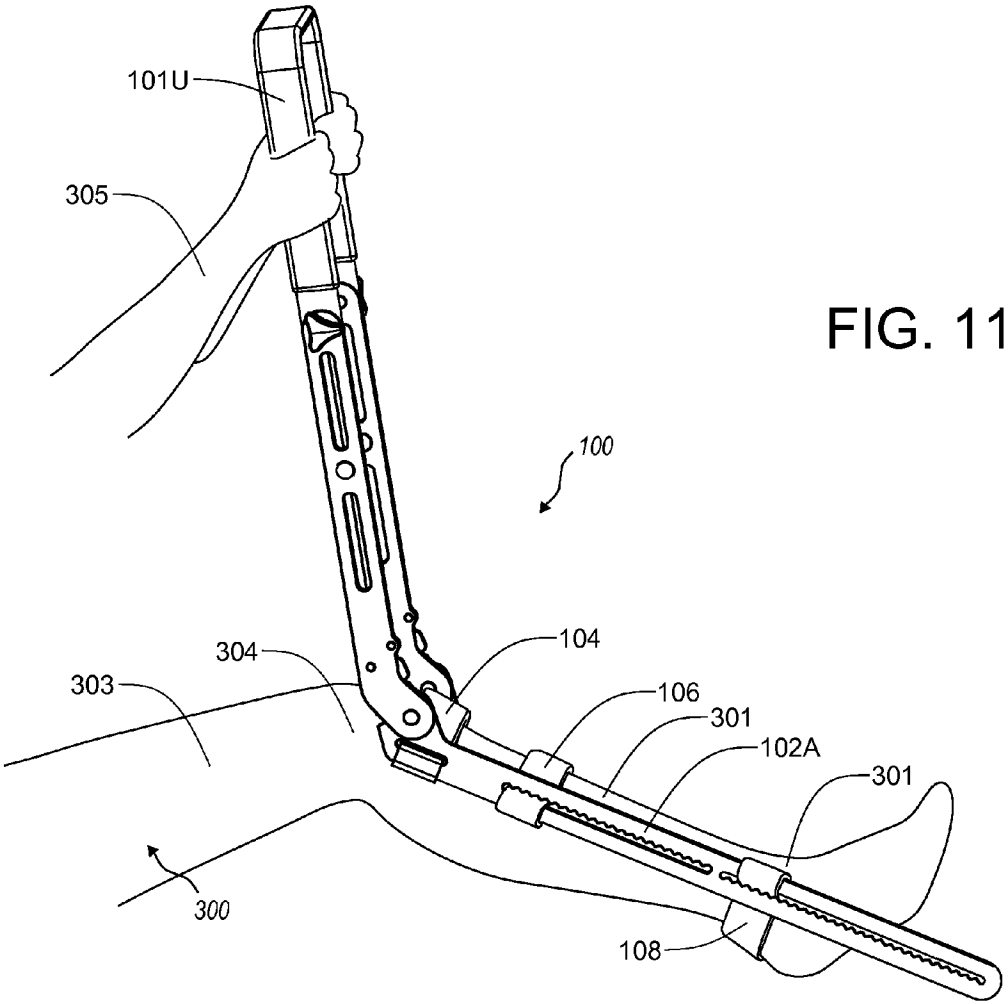

Referring now to FIG. 11, the first embodiment knee rehabilitation device 100 is shown in use by a patient 300 in a fourth configuration, with the upper band 104 positioned just below the knee 304 on the anterior surface of the patient's lower leg 303, the middle band 106 also positioned on the anterior surface of the lower leg 303 below the upper band 104, and the lower band 108 positioned posterior to the ankle 301. In this fourth configuration, pressure applied to the knee 304 is maximized during therapy sessions.

Figure 12:
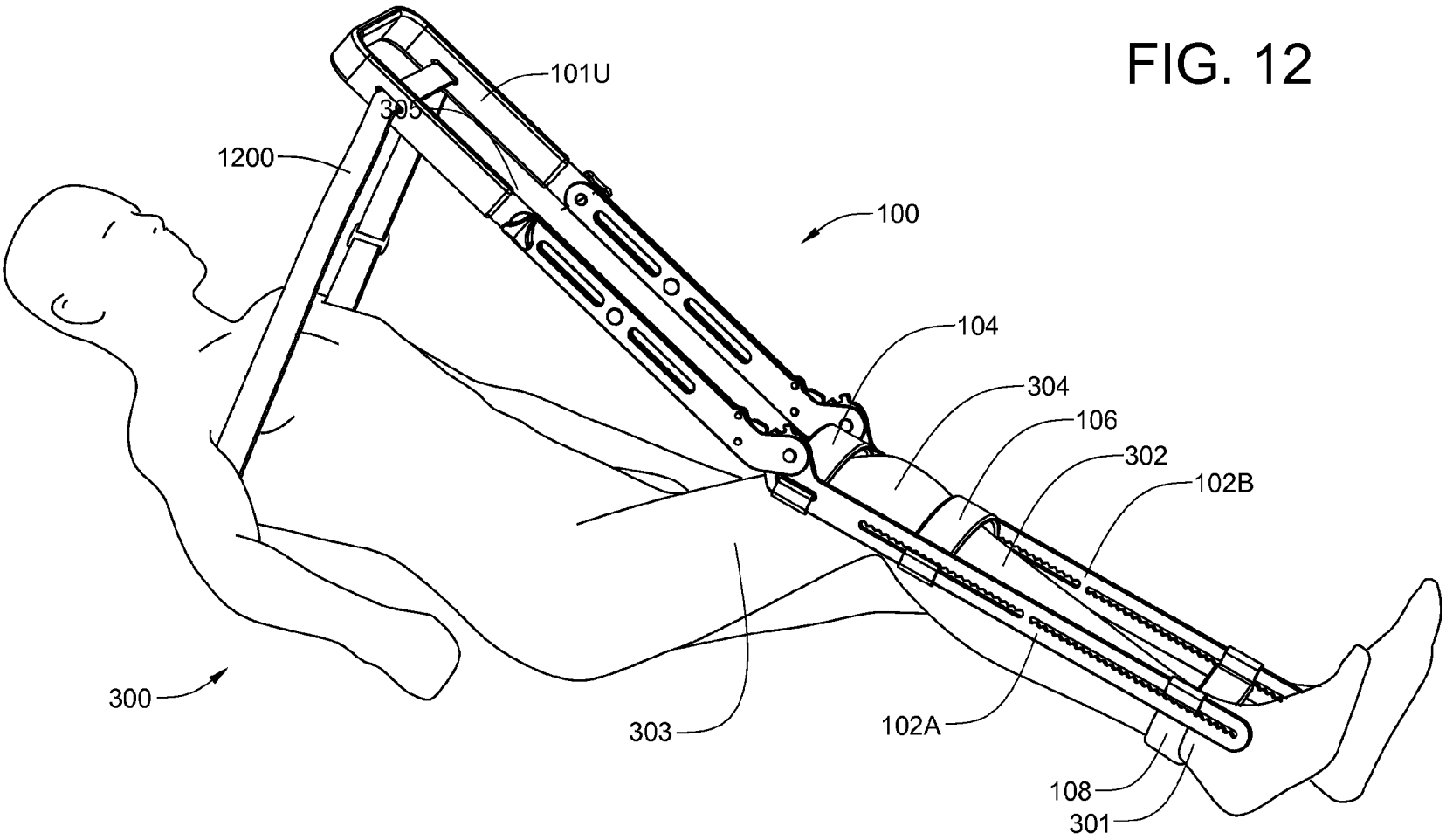
FIG. 12 is an isometric view of the first embodiment knee rehabilitation device being used by a patient in combination with a torso band.

Referring now to FIG. 12, is an isometric view of the first embodiment knee rehabilitation device 100 being used by a patient 300 in combination with a torso band 1200. The torso band 1200 can be employed to maintain a particular angle of flexion or extension of the leg being rehabilitated.

Figure 13:
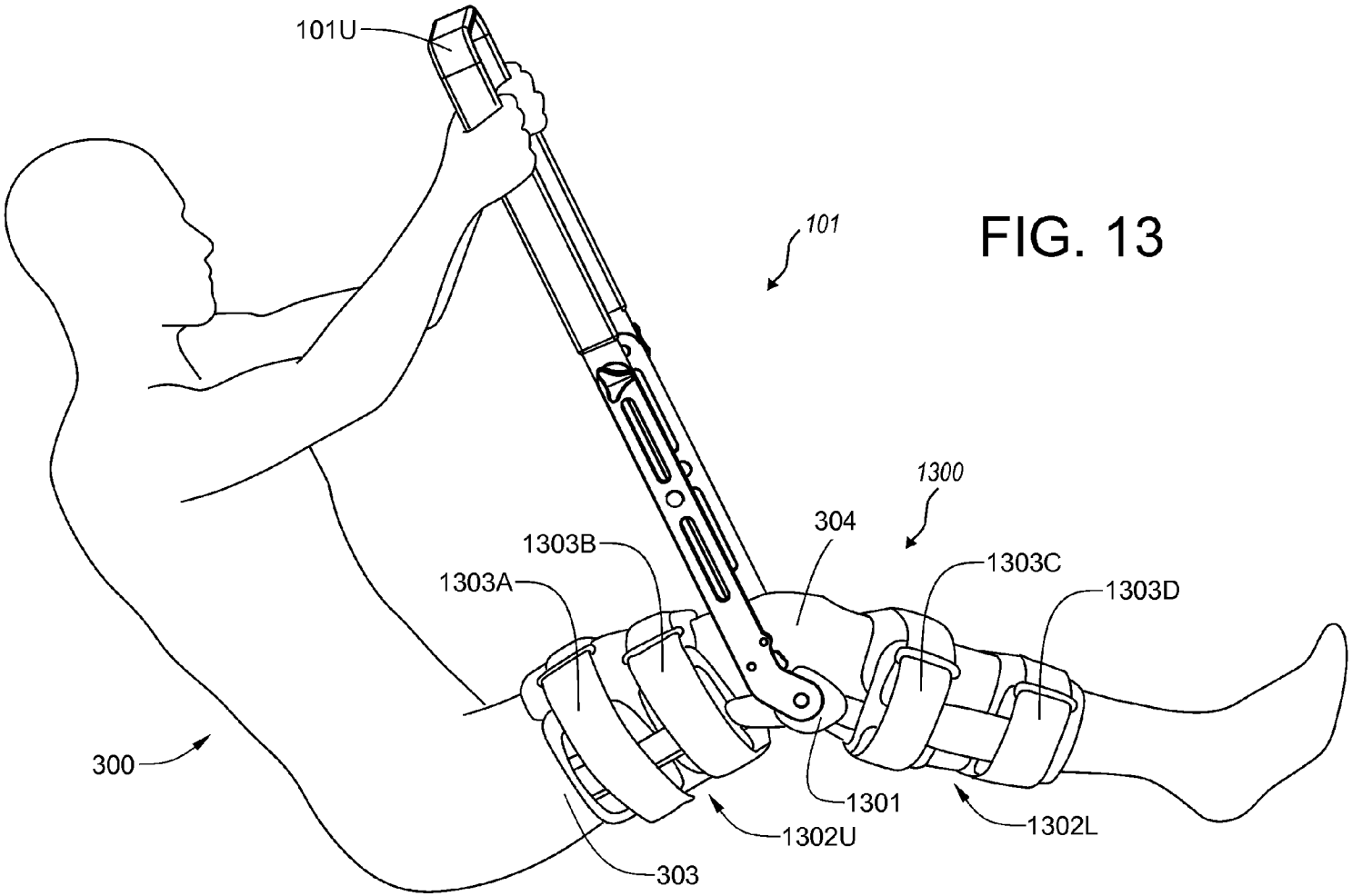
FIG. 13 is an isometric view of the handle of the first embodiment knee rehabilitation device being used by a patient in combination with a conventional knee brace that has been modified to include handle attachment hardware, as well as additional support structure and bands.

Referring now to FIG. 13, the U-shaped handle 101 of the first embodiment knee rehabilitation device 100 is shown being used by a patient 300 in combination with a conventional knee brace 1300 that has been modified to include handle attachment hardware 1301, as well as additional support structure (1302U and 1302L), and bands 1303A-1303D.

Figure 14:
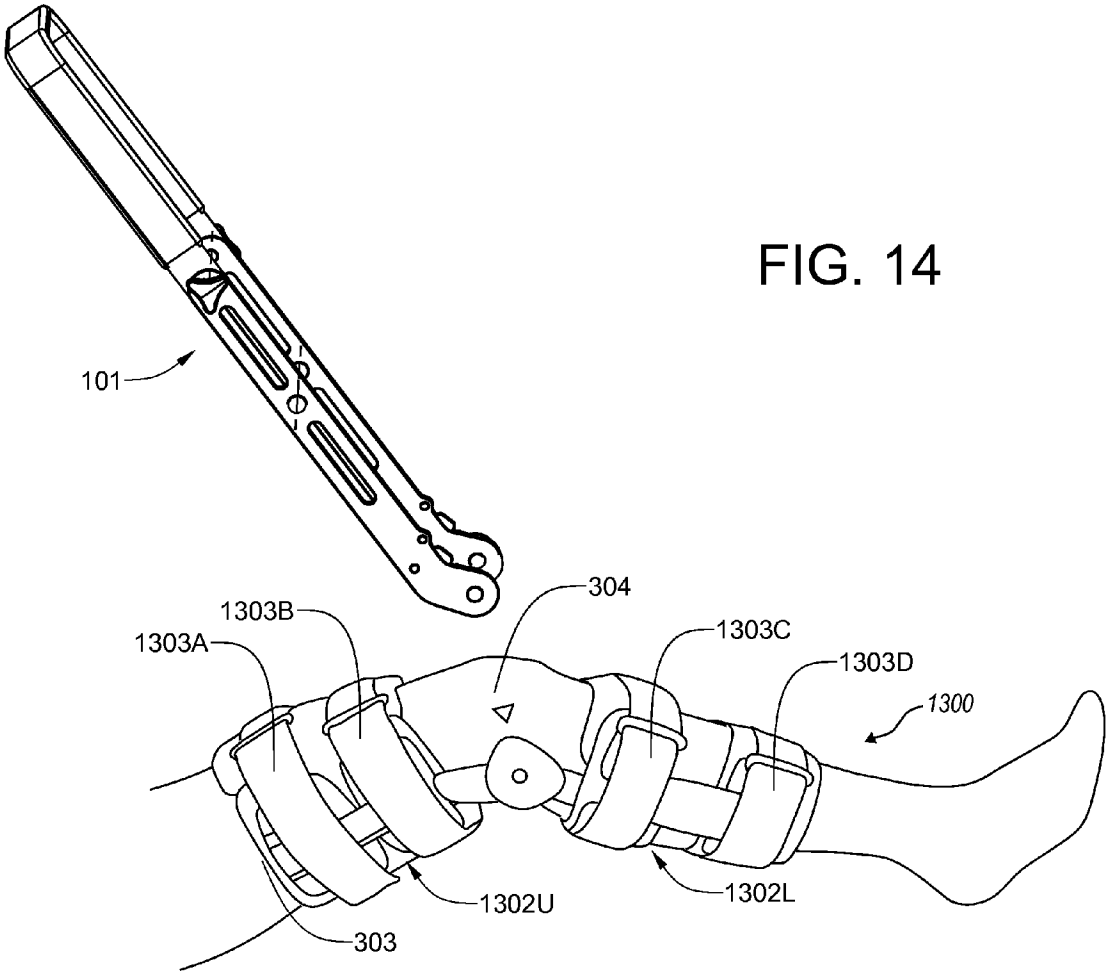
FIG. 14 is an isometric view of the assembly of FIG. 13, with the handle removed from the knee brace.

Referring now to FIG. 14, the assembly of is an isometric view of the assembly of FIG. 13, with the handle 101 removed from the knee brace 1300.

Figure 15:
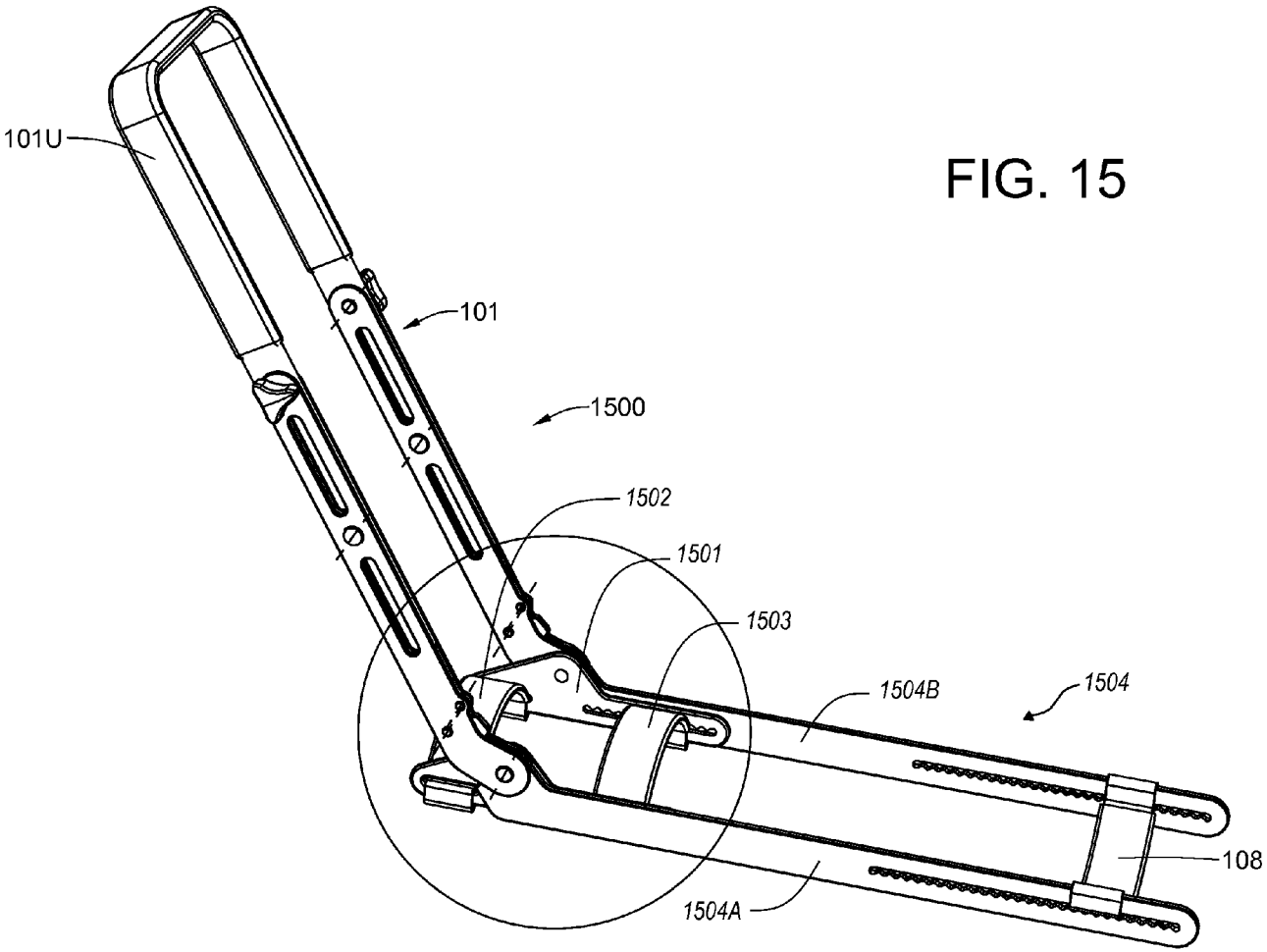
FIGS. 15, 16 and 17 show a second embodiment knee rehabilitation device in which the upper pair of knee bands are allowed to rotate independently of the ankle band, with each of the three figures showing a different degree of rotation.
Figure 16:
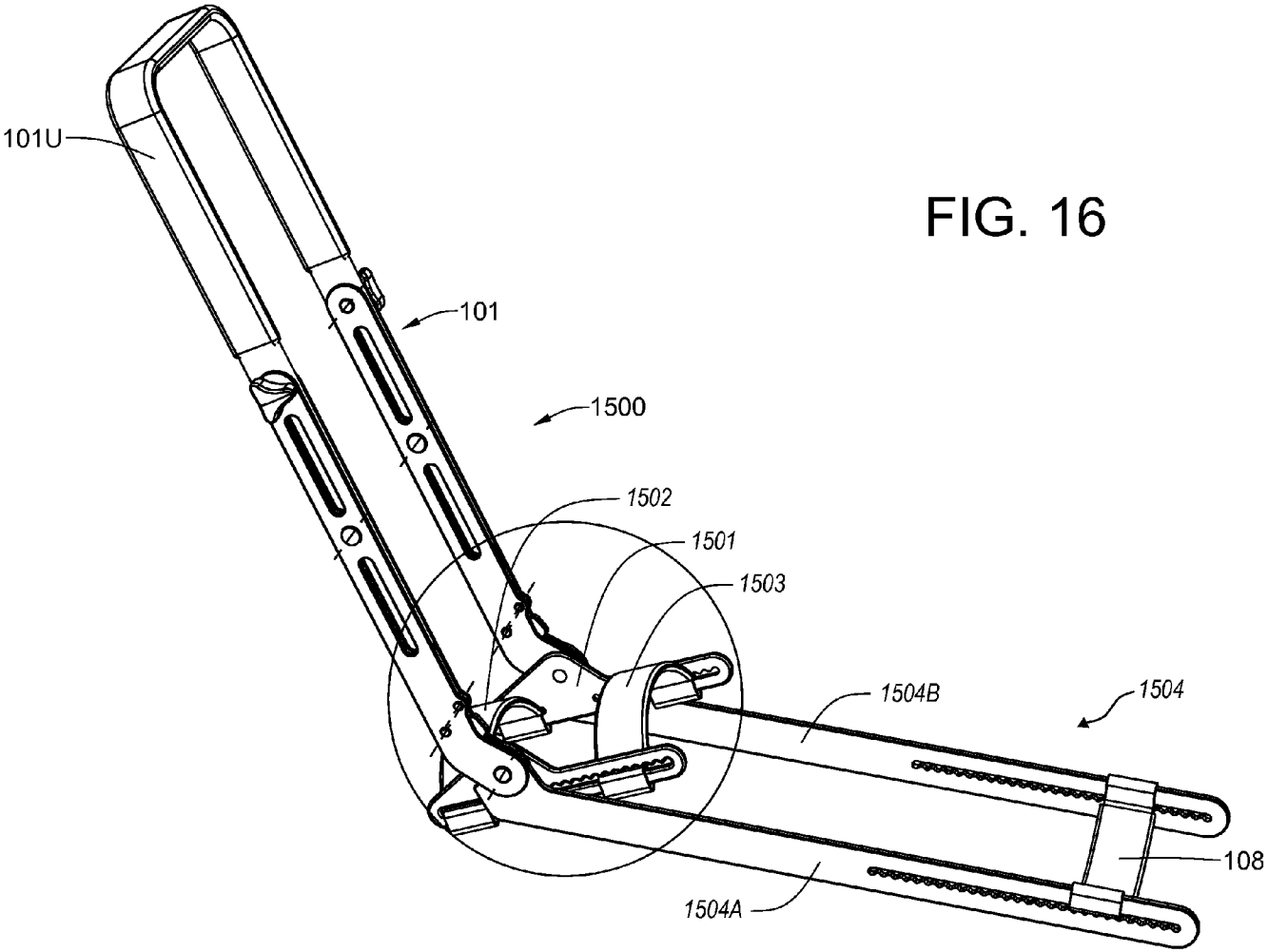
Figure 17:
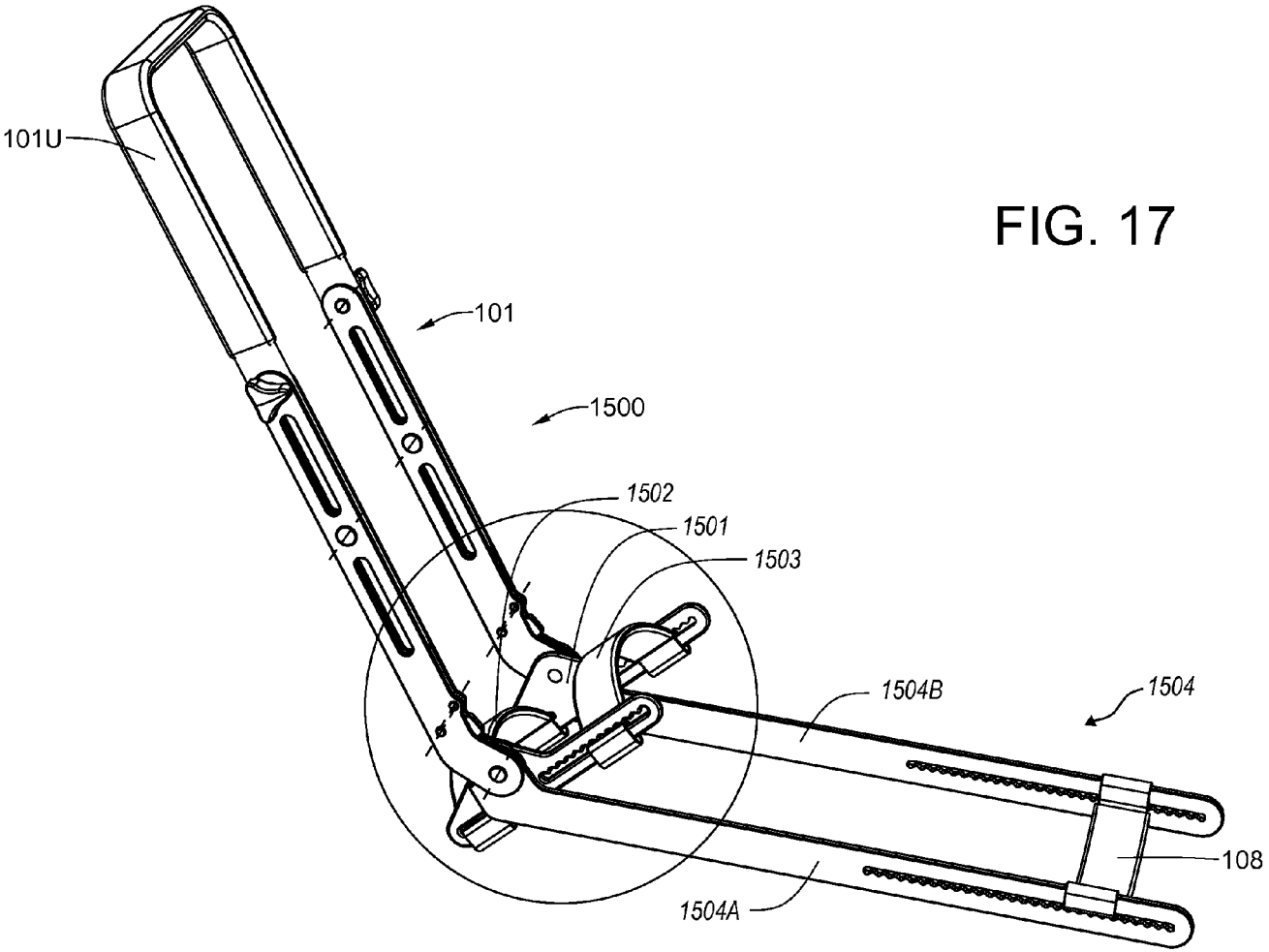

Referring now to FIGS. 15, 16 and 17, a second embodiment knee rehabilitation device 1500, which is a variation of the first embodiment knee rehabilitation device 100, incorporates a rotatable support structure 1501, to which the upper and middle bands 1502 and 1503, respectively, attach. The rotatable support structure 1501 enables the upper and middle bands 1502 and 1503 to rotate independently of the leg support 1504. FIGS. 15, 16 and 17 each show a different degree of rotation of the rotatable support structure 1501.

Figure 18:
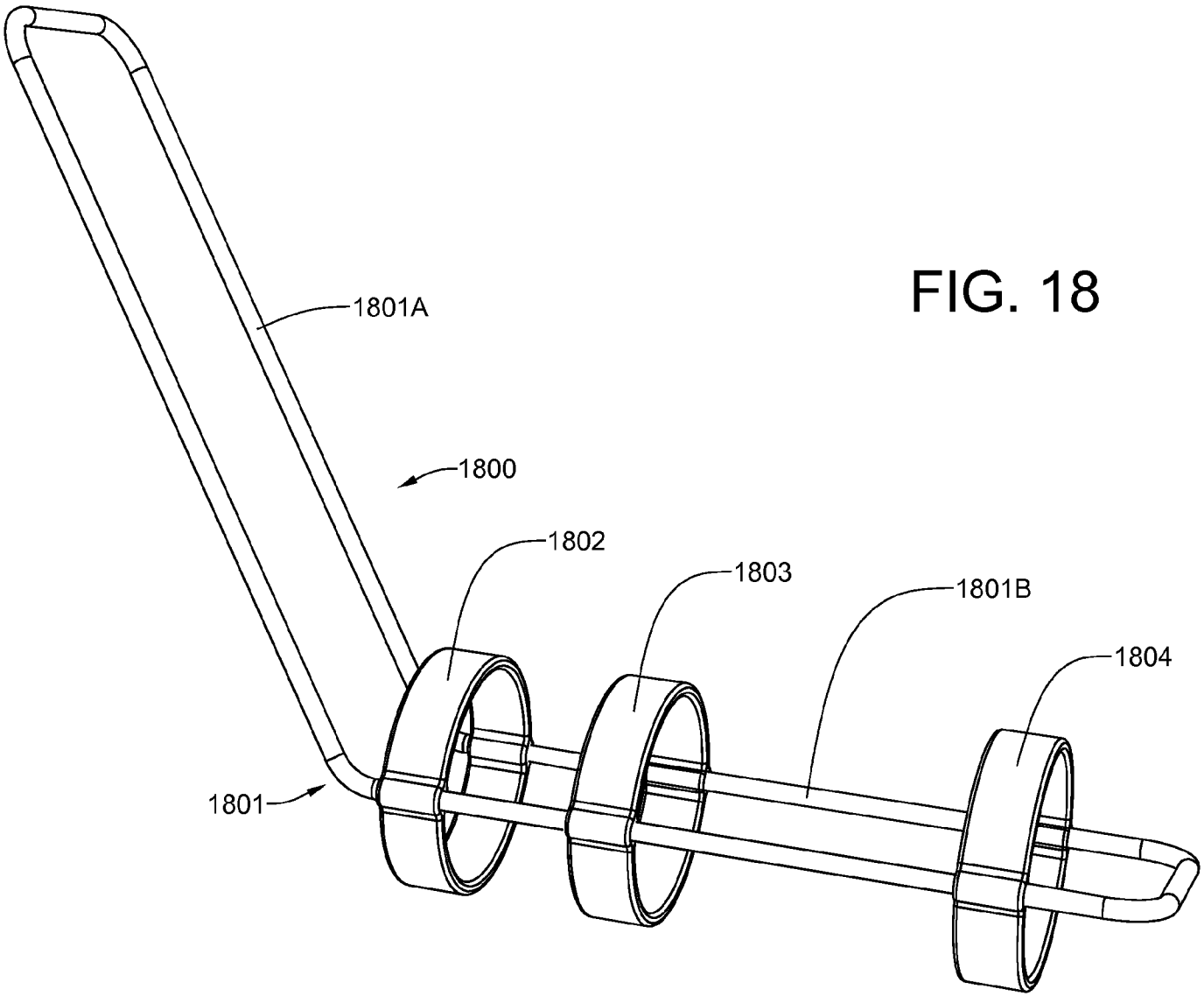
FIG. 18 is an isometric view from an upper right-side vantage point of a basic, less-expensive third embodiment knee rehabilitation device having a non-adjustable tubular frame and three slidable, adjustable & bands.
Figure 19:
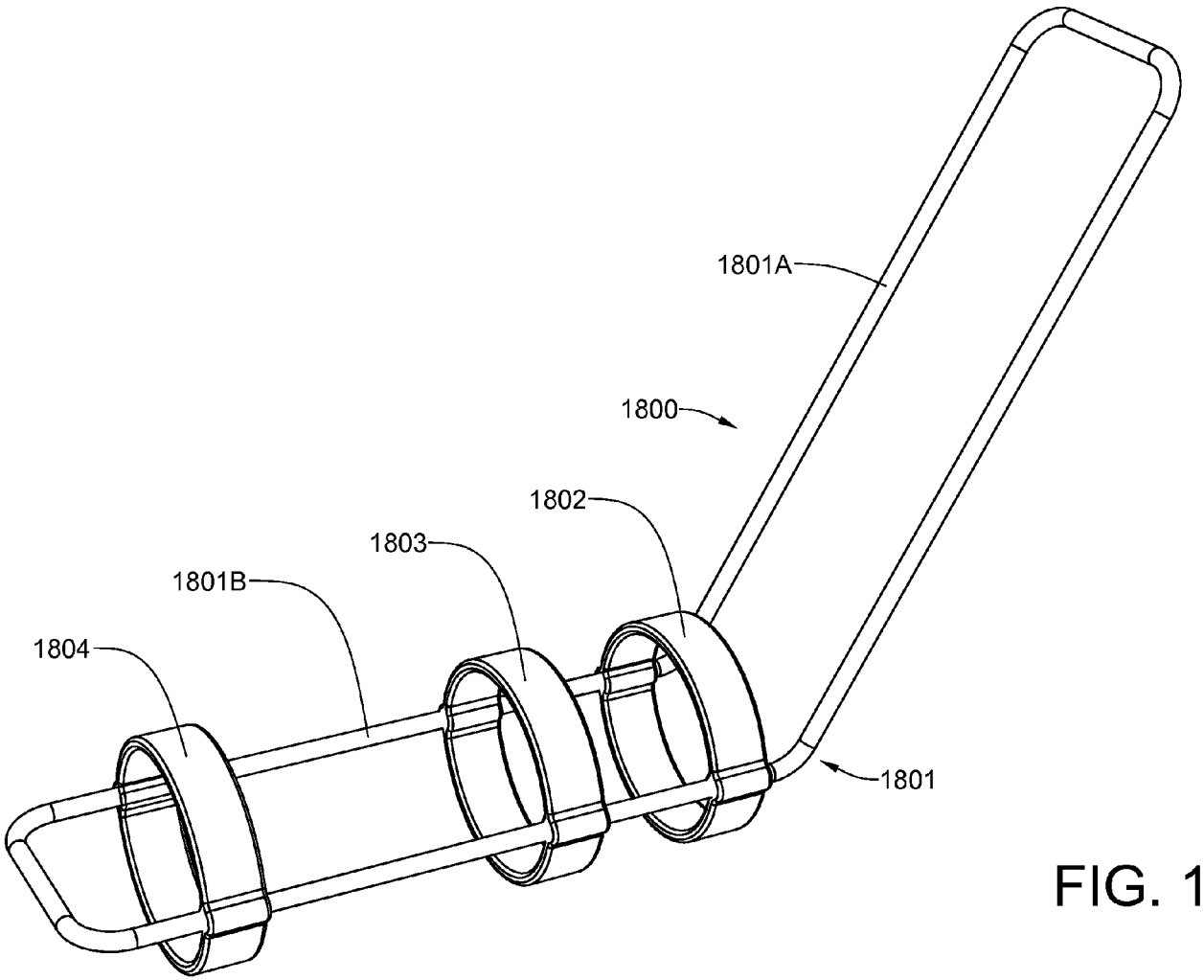
FIG. 19 is an isometric view from an upper-front, right-side vantage point of the third embodiment knee rehabilitation device.

Referring now to FIGS. 18 and 19, a third embodiment knee rehabilitation device 1800 has a non-adjustable tubular metal frame 1801 in which the handle portion 1801A is rigidly affixed to a leg support portion 1801B. An upper band 1802, a middle band 1803 and a lower band 1804 can be slidably positioned along the parallel tubes of the leg support portion 1801B.

Figure 20:
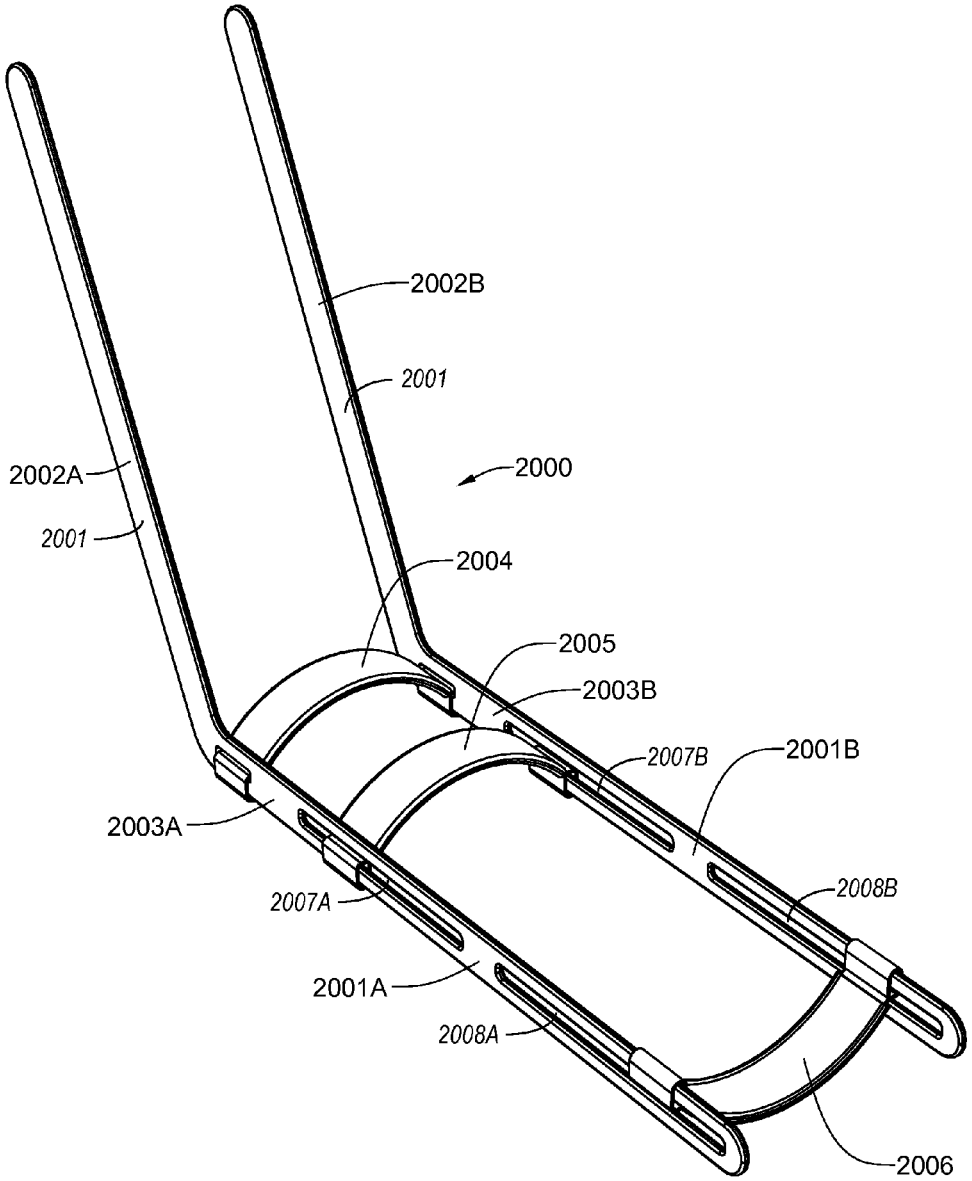
FIG. 20 is an isometric view from an upper-front, right-side vantage point of a fourth embodiment knee rehabilitation device having a non-adjustable frame made of laminar sheet material having a fixed upper band, and slidably movable middle and lower s bands.
Figure 21:
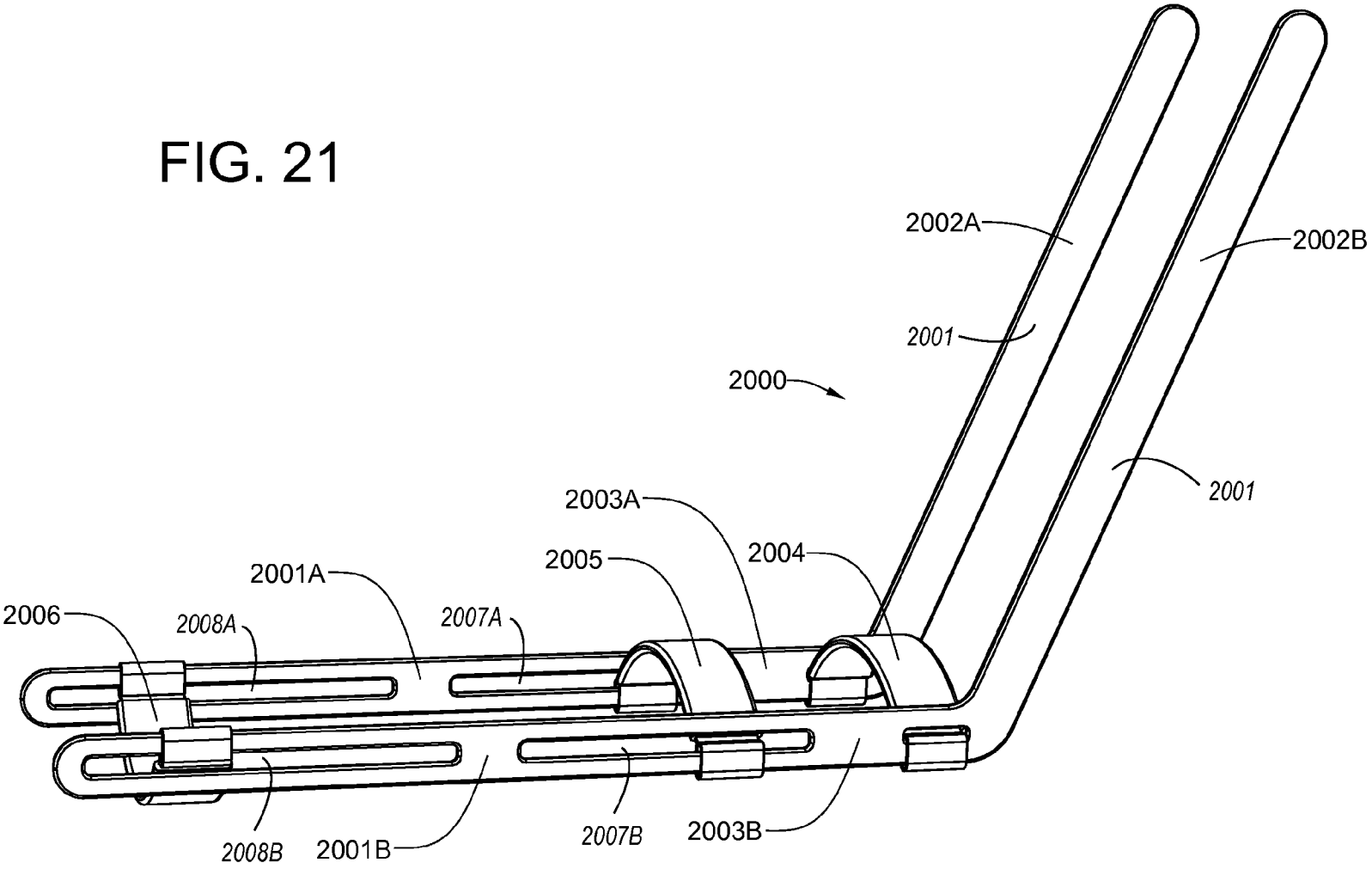
FIG. 21 is an isometric view from an upper-left vantage point of the fourth embodiment knee rehabilitation device.
Figure 22:
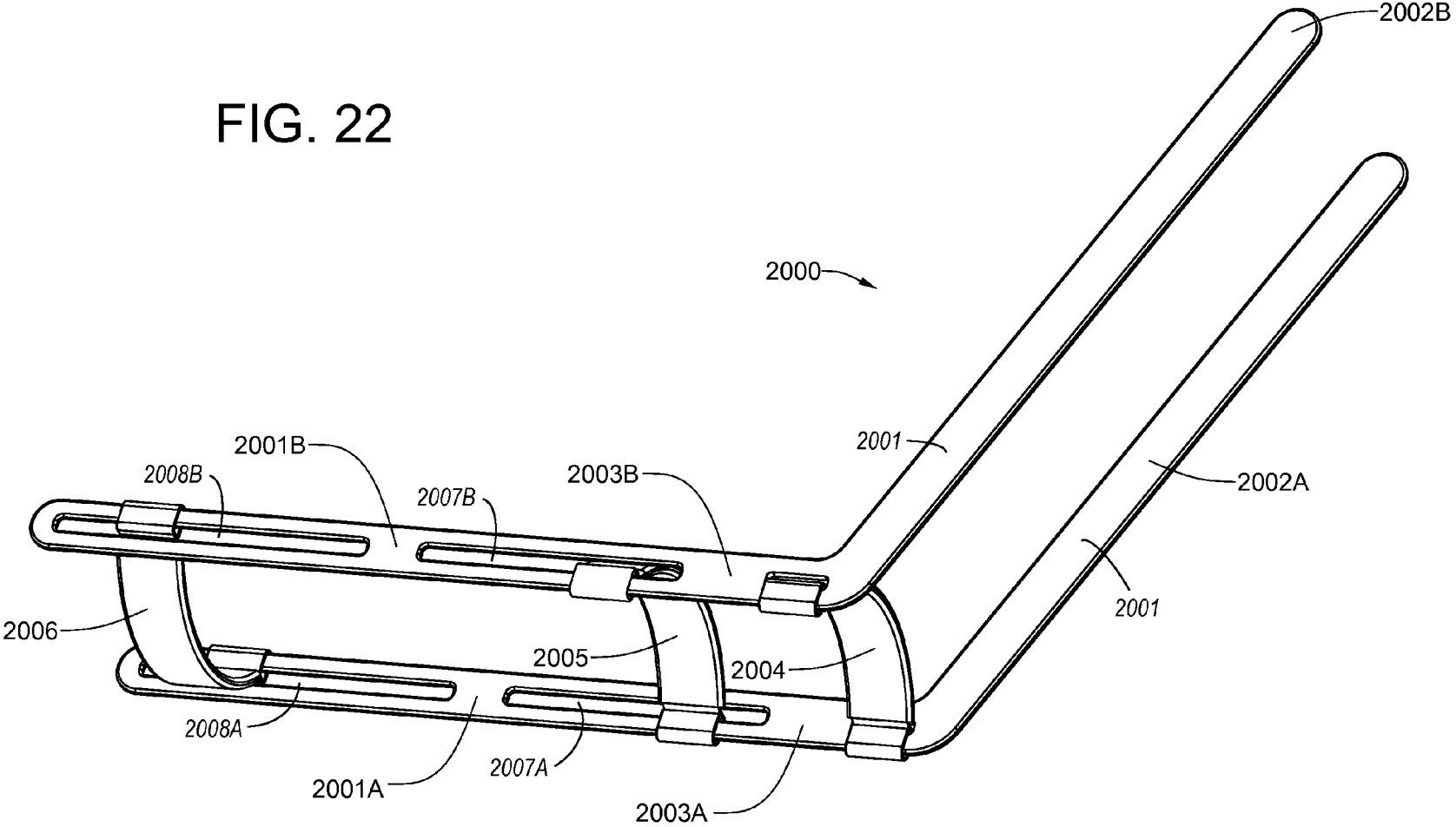
FIG. 22 is an isometric view from a lower-left rear vantage point of the fourth embodiment knee rehabilitation device.

Referring now to FIGS. 20, 21 and 22, a fourth embodiment knee rehabilitation device 2000 has a non-adjustable frame 2001 made of a pair of laminar sheet material components 2001A and 2001 B disposed in a mutually-parallel configuration. The laminar sheet material can be a structural metal such as aluminum, steel alloys, stainless steel alloys, magnesium alloys and titanium. It can also be a polymeric material, such as polyester thermoplastic resin that is reinforced by structural fibers such as para-aramid (e.g., Kevlar®), glass and carbon. Each of the frame components 2001A and 2001B is reminiscent of a hockey stick or boomerang, with a first end 2002A and 2002B of each serving as a handle and the other end 2003A and 2003B serving as half of the leg support portion. Front, middle and rear bands (2004, 2005 and 2006, respectively) bridge the gap between the two frame components 2001A and 2001B. Each frame component is equipped with a pair of longitudinal slots 2007A, 2008A and 2007B, 2008B, in the leg support portion 2003A/2003B, which enable the front and middle bands 2005 and 2006 to adjustably slide back and forth in order to accommodate different sizes of patients and different therapy positions.

Figure 23:
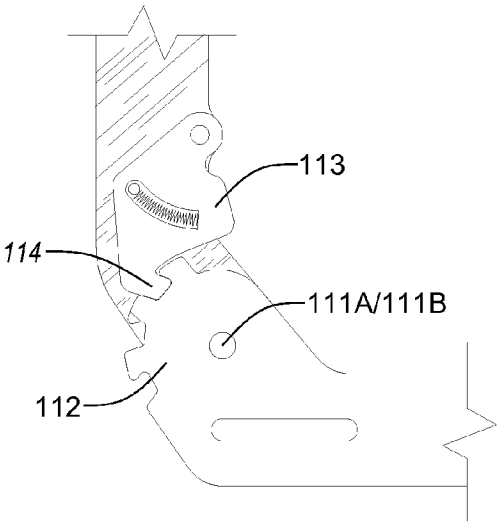
FIG. 23 is a cut-away drawing of the notched locking disc and pawl, with the pawl engaging the third notch of the locking disc.

Referring now to FIG. 23, the notched locking disc 112 and pawl 114, with the pawl 114 engaging the third notch of the locking disc 112 are shown. The release button 113 is unitary with the pawl.

Figure 24:
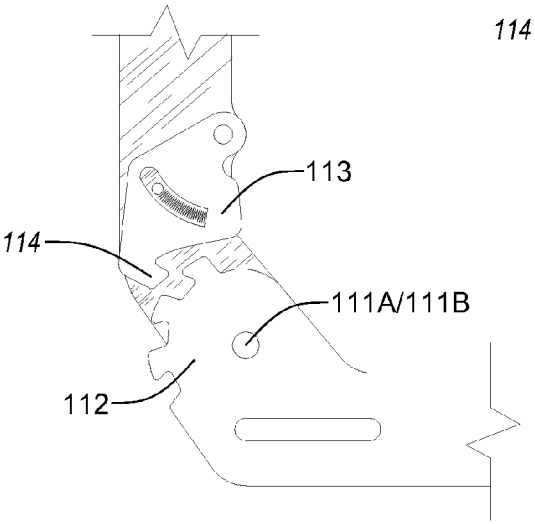
FIG. 24 is a cut-away drawing of the notched locking disc and pawl, with the pawl disengaged from the locking disc.

Referring now to FIG. 24, the release button 113 has been depressed, thereby disengaging the pawl 114 from the locking disc 112.

Figure 25:
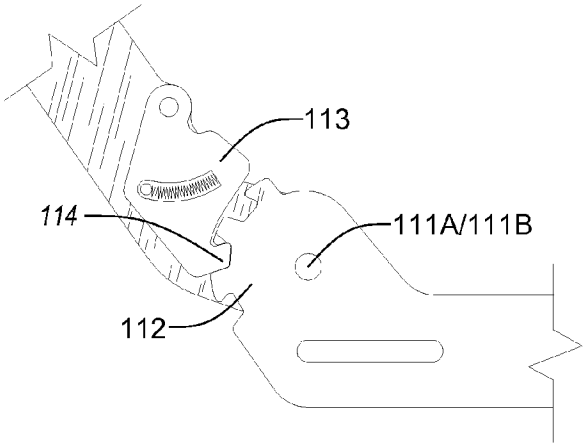
FIG. 25 is a cut-away drawing of the notched locking disc and pawl, with the pawl engaging the second notch of the locking disc.

Referring now to FIG. 25, the release button 113 has been allowed to spring back to its locked position, where the pawl 114 has engaged the second notch of the locking disc 112.

Although only several embodiments of the new device have been disclosed herein, it will be obvious to those having ordinary skill in the art that changes and modifications may be made thereto without departing from the scope and spirit of the invention as hereinafter claimed.

What is claimed is:

1. A rehabilitation device for facilitating range of motion in an impaired knee joint of a patient's leg, said rehabilitation device comprising:

a fixed length leg support having first and second spaced-apart, generally parallel elongate members having proximal and distal ends, an ankle band suspended between said elongate members, wherein a position of the ankle band relative to the distal ends of the elongate members is adjustable, and an over-front-of-the-leg band suspended between said elongate members near the proximal ends thereof, wherein a position of the over-front-of-the-leg band relative to the proximal ends of the elongate members is fixed;

a handle rotatably coupled to the proximal ends of the elongate members; and an angularly-adjustable coupler by way of which the handle is rotatably coupled to the elongate members, wherein the angularly-adjustable coupler is operable to implement variations to an angle cooperatively defined by the handle and the leg support, and the angularly-adjustable coupler including a locking mechanism operable to releasably lock the handle at a plurality of different angular positions relative to the leg support.

2. The rehabilitation device of claim 1, wherein said handle can be folded upon said leg support in a storage configuration.

3. The rehabilitation device of claim 1, further comprising a second over-front-of-the-leg band suspended between the elongate members of the leg support and positioned between the ankle band and the first over-front-of-the-leg band, wherein a position of the second over-front-of-the-leg band is adjustable relative to both the proximal and distal ends of the elongate members of the leg support.

4. The rehabilitation device of claim 3, wherein said ankle band and said second over-front-of the leg band are slidably attached to said elongate members.

5. The rehabilitation device of claim 3, wherein said first and second over-front-of-the-leg bands and said ankle band completely encircle the ankle, the thigh and the upper portion of the lower leg.

6. The rehabilitation device of claim 1, wherein said elongate members and said handle are fabricated from at least one structural material selected from the group consisting of mild steel, stainless steel, titanium, aluminum, magnesium, and structural-fiber-reinforced thermoplastic resin.

7. The rehabilitation device of claim 1, wherein said handle is of adjustable length.

8. The rehabilitation device of claim 1 further comprising a strap operable to releasably secure a patient's torso to the handle.

9. The rehabilitation device of claim 1 wherein the angularly-adjustable coupler comprises a pair of notched elements and pawls arranged so that each pawl can engage in various of notches in a corresponding notched element to achieve a desired angle between the handle and the leg support.

10. The rehabilitation device of claim 9 wherein each notched element is integral with an associated elongate member.

11. The rehabilitation device of claim 1 wherein each of the elongate members defines a slot to which a corresponding end of the ankle band is slidably connected, the slot having a length that defines a range of motion for the ankle band relative to the distal ends of the elongate members.

12. The rehabilitation device of claim 11 further comprising a second over-front-of-the-leg band positioned between the ankle band and the first over-front-of-the-leg band, and wherein each of the elongate members defines an additional slot to which a corresponding end of the second over-front-of-the-leg band is slidably connected, the additional slots having a length that defines a range of motion for the second over-front-of-the-leg band relative to the proximal ends of the elongate members.

13. The rehabilitation device of claim 12 wherein the ankle band and the second over-front-of-the-leg band are movable independent of each other.

14. The rehabilitation device of claim 12 wherein one edge of each the slots is ridged to aid in retention of an associated band when a force is exerted on that band.

15. The rehabilitation device of claim 1 wherein in operation, the over-front-of-the-leg band is located above the knee of the patient and serves as a fulcrum to effect a rotational movement in the knee as a result of a downward force exerted on the handle.

16. The rehabilitation device of claim 1 wherein the locking mechanism includes a pair of release buttons, and unlocking of the locking mechanism is effected by depressing the pair of release buttons.

17. The rehabilitation device of claim 1 wherein the generally parallel elongate members are substantially the same distance apart from each other over their entire respective lengths.

18. A rehabilitation device suitable for use in connection with a knee joint of a patient, the rehabilitation device comprising:

a fixed length leg support having first and second spaced-apart, generally parallel elongate members having proximal and distal ends;

an ankle band suspended between the elongate members, wherein a position of the ankle band relative to the distal and proximal ends of the elongate members is adjustable;

a first over-front-of-the-leg band suspended between the elongate members near the proximal ends thereof and removable from the elongate members, wherein a position of the first over-front-of-the-leg band relative to the distal and proximal ends of the elongate members is fixed, and wherein the rehabilitation device is operable to effect rotation of the knee joint even when the first over-front-of-the-leg band has been removed;

a second over-front-of-the-leg band suspended between the elongate members and positioned between the ankle band and the first over-front-of-the-leg band, wherein a position of the second over-front-of-the-leg band relative to the distal and proximal ends of the elongate members is adjustable;

a handle rotatably coupled to the proximal ends of the elongate members; and an angularly-adjustable coupler by way of which the handle is rotatably coupled to the elongate members, wherein the angularly-adjustable coupler is operable to implement variations to an angle cooperatively defined by the handle and the leg support, and the angularly-adjustable coupler including a locking mechanism operable to releasably lock the handle at a plurality of different angular positions relative to the leg support.

19. The rehabilitation device of claim 18, wherein:

each of the elongate members defines a first slot to which a respective end of the ankle band is slidably connected, the first slots each having a length defining a range of motion for the ankle band relative to the distal and proximal ends of the elongate members; and each of the elongate members defines a second slot to which a respective end of the second over-front-of-the-leg band is slidably connected, the second slots each having a length defining a range of motion for the ankle band relative to the distal and proximal ends of the elongate members, wherein the respective ranges of motion for the ankle band and the second over-front-of the leg band are adequate to enable placement of the first over-front-of-the-leg band below the knee while also enabling placement of the ankle band beneath an ankle of the patient.

20. The rehabilitation device of claim 18, wherein the handle is removable from the elongate members and attachable to a knee brace.

* * * * *